US008156908B2

(12) United States Patent
Nishida et al.

(10) Patent No.: US 8,156,908 B2
(45) Date of Patent: Apr. 17, 2012

(54) ENGINE AND VEHICLE COMPRISING ENGINE

(75) Inventors: Toru Nishida, Akashi (JP); Kazuki Nagasawa, Akashi (JP); Yoshio Watanabe, Kakogawa (JP); Yoji Fukami, Kakogawa (JP); Toshiyuki Yanamoto, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 446 days.

(21) Appl. No.: 12/396,364

(22) Filed: Mar. 2, 2009

(65) Prior Publication Data

US 2009/0229552 A1 Sep. 17, 2009

(30) Foreign Application Priority Data

Mar. 3, 2008 (JP) ..... 2008-051633

(51) Int. Cl.
*F01L 1/18* (2006.01)

(52) U.S. Cl. ..... 123/90.44; 123/90.16

(58) Field of Classification Search ..... 123/90.16, 123/90.44

See application file for complete search history.

(56) References Cited

U.S. PATENT DOCUMENTS

2002/0023603 A1 2/2002 Nohara et al.
2002/0088416 A1 7/2002 Nakamura et al.
2003/0226531 A1* 12/2003 Miyazato et al. ..... 123/90.16
2005/0279304 A1* 12/2005 Yamada ..... 123/90.16
2006/0174849 A1 8/2006 Okamoto

FOREIGN PATENT DOCUMENTS

| | | |
|---|---|---|
| EP | 1162350 | 12/2001 |
| EP | 1229217 | 8/2002 |
| EP | 1234968 | 8/2002 |
| EP | 1288453 | 3/2003 |
| EP | 1541815 | 6/2005 |
| EP | 1669560 | 6/2006 |
| JP | 06-074010 | 3/1994 |
| JP | 2000/291418 | 10/2000 |
| JP | 2000/314306 | 11/2000 |

OTHER PUBLICATIONS

ISA European Patent Office, Search Report of EP09002961, Jul. 7, 2009, Germany, 7 pages.

* cited by examiner

*Primary Examiner* — Zelalem Eshete
(74) *Attorney, Agent, or Firm* — Alleman Hall McCoy Russell & Tuttle LLP

(57) ABSTRACT

An engine of the present invention comprises a valve body configured to open and close ports and formed in a cylinder head, a drive cam mechanism operable in association with a crankshaft by a driving power transmission mechanism, a pivot cam mechanism which is configured to be pivoted according to movement of the drive cam mechanism to cause the valve body to open and close and is configured to change a pivot state to change a lift characteristic of the valve; and a servo motor configured to change the pivot state of the pivot cam mechanism, wherein the servo motor is positioned at one end portion of the pivot cam mechanism such that the servo motor is distant from the driving power transmission mechanism.

12 Claims, 17 Drawing Sheets

ENGINE AND VEHICLE COMPRISING ENGINE

TECHNICAL FIELD

The present invention relates to an engine including a valve operating system configured to drive a valve for opening and closing a port formed in a cylinder head and a vehicle comprising the engine.

BACKGROUND ART

A variable valve timing control system for an engine is configured such that a crankshaft of the engine is coupled to a drive cam by a driving power transmission mechanism such as a chain, the drive cam rotates in association with rotation of the crankshaft and a pivot cam mechanism causes an intake valve and an exhaust valve to reciprocate in association with rotation of the drive cam. The variable valve timing control system is configured to change a pivot range and a pivot phase of the pivot cam mechanism to change lift characteristics of the intake valve and the exhaust valve (see patent document 1). The variable valve timing control system is disposed inside a cylinder head cover above a cylinder.

A pivot cam mechanism for a variable valve timing control system disclosed in Japanese Laid-Open Patent Application Publication No. Hei. 6-74010 includes a pivot cam configured to contact a tappet of a valve, a pivot arm configured to contact a drive cam, and a rotatable pivot camshaft. The pivot cam mechanism further includes a rotary member configured to rotate the pivot cam relative to the pivot camshaft. In the pivot cam mechanism, the rotary member applied with a driving power from a drive means causes the pivot cam to rotate. The rotation changes a relative angle around the pivot camshaft between the pivot arm and the pivot cam, changing the lift characteristics.

In the variable valve timing system, the rotary member configured to rotate the pivot cam is positioned near the valve. To be specific, the rotary member is positioned between the pivot cam and the pivot arm. A cylinder member is provided to directly drive the rotary member. The cylinder member is also positioned near the rotary member. To be specific, the cylinder member is disposed inside a casing of the engine and positioned in the vicinity of the valve, such as in the rotary member. In a structure in which the cylinder member and the rotary member are positioned in the vicinity of the valve in this way, design of the cylinder member and the rotary member is restricted to a considerable extent, because the shapes and arrangement of them affect each other. For this reason, flexibility of the design of the engine is lessened.

SUMMARY OF THE INVENTION

Accordingly, an object of the present invention is to provide an engine which includes a valve operating system capable of changing lift characteristics of a valve using a driving source and is designed flexibly, and a vehicle comprising the engine.

The present invention has been made in view of the circumstances, and an engine of the present invention comprises a valve configured to open and close a port formed in a cylinder head; a drive cam mechanism operable in association with a crankshaft by a driving power transmission mechanism; a pivot cam mechanism which is configured to be pivoted according to movement of the drive cam mechanism to cause the valve to open and close and is configured to change a pivot state to change a lift characteristic of the valve;

and a driving source configured to change the pivot state of the pivot cam mechanism; wherein the driving source is positioned at one end portion of the pivot cam mechanism such that the driving source is distant from the driving power transmission mechanism.

In accordance with the present invention, the driving source is disposed at one end portion of the pivot cam mechanism such that the driving source is distant from the driving power transmission mechanism. Therefore, the driving source does not affect the shapes and arrangement of the driving power transmission mechanism and the pivot cam mechanism in design, and therefore there is less restriction in the design of these components. That is, flexibility of design of the engine is improved. That is, in accordance with the present invention disclosure, in the engine including the valve operating system capable of changing the lift characteristics of the valve by using the driving source, high design flexibility is attained.

DETAILED DESCRIPTION OF THE INVENTION

Hereinafter, embodiments of the present invention will be described with reference to the drawings.

Figure 1:
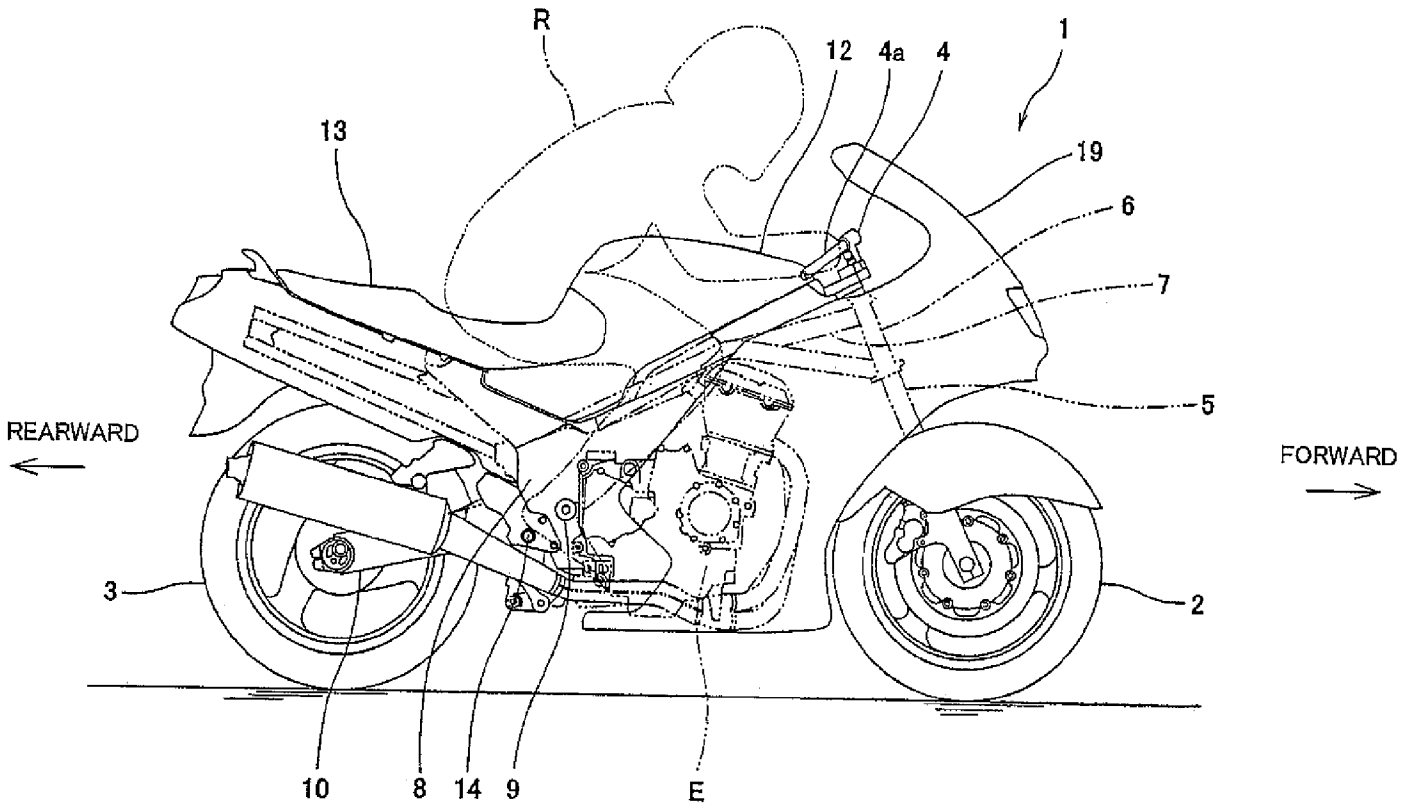
FIG. 1 is a right side view of a motorcycle in which an engine E according to Embodiment 1 of the present invention is mounted.

FIG. 1 is a right side view of a motorcycle 1 in which an engine E according to Embodiment 1 of the present invention is mounted. As used herein, the directions used in Embodiment 1 and Embodiment 2 of the present invention are referenced from a rider R mounting the motorcycle 1.

As shown in FIG. 1, the motorcycle 1 includes a front wheel 2 and a rear wheel 3. The front wheel 2 is rotatably mounted to a lower end portion of a front fork 5 extending substantially vertically. The front fork 5 is mounted to a steering shaft (not shown) by an upper bracket (not shown) provided at an upper end portion thereof and an under bracket (not shown) provided under the upper bracket. The steering shaft is rotatably mounted by a head pipe 6. A bar-type steering handle 4 extending rightward and leftward is mounted to the upper bracket. By the rider R's operation for rotating the steering handle 4, the front wheel 2 can be rotated in a desired direction around the steering shaft.

A pair of right and left main frame members 7 forming a vehicle body frame extend rearward from the head pipe 6. A pivot frame member 8 extends downward from a rear portion of each of the main frame members 7. A swing arm 10 is mounted at a front end portion thereof to a pivot 9 provided at the pivot frame member 8. The rear wheel 3 is rotatably mounted to a rear end portion of the swing arm 10.

A fuel tank 12 is disposed above the main frame members 7 and behind the steering handle 4. A straddle-type seat 13 is disposed behind the fuel tank 12. An engine E is mounted below the right and left main frame members 7. A driving power of the engine E is transmitted to the rear wheel 3 via a chain (not shown). The rear wheel 3 rotates, enabling a propulsive force to be generated in the motorcycle 1. Mounting the seat 13, the rider R rides the motorcycle 1. Gripping grips 4*a* provided at end portions of the steering handle 4, and putting feet on steps 14 provided in the vicinity of the rear portion of the engine E, the rider R drives the motorcycle 1.

Figure 2:
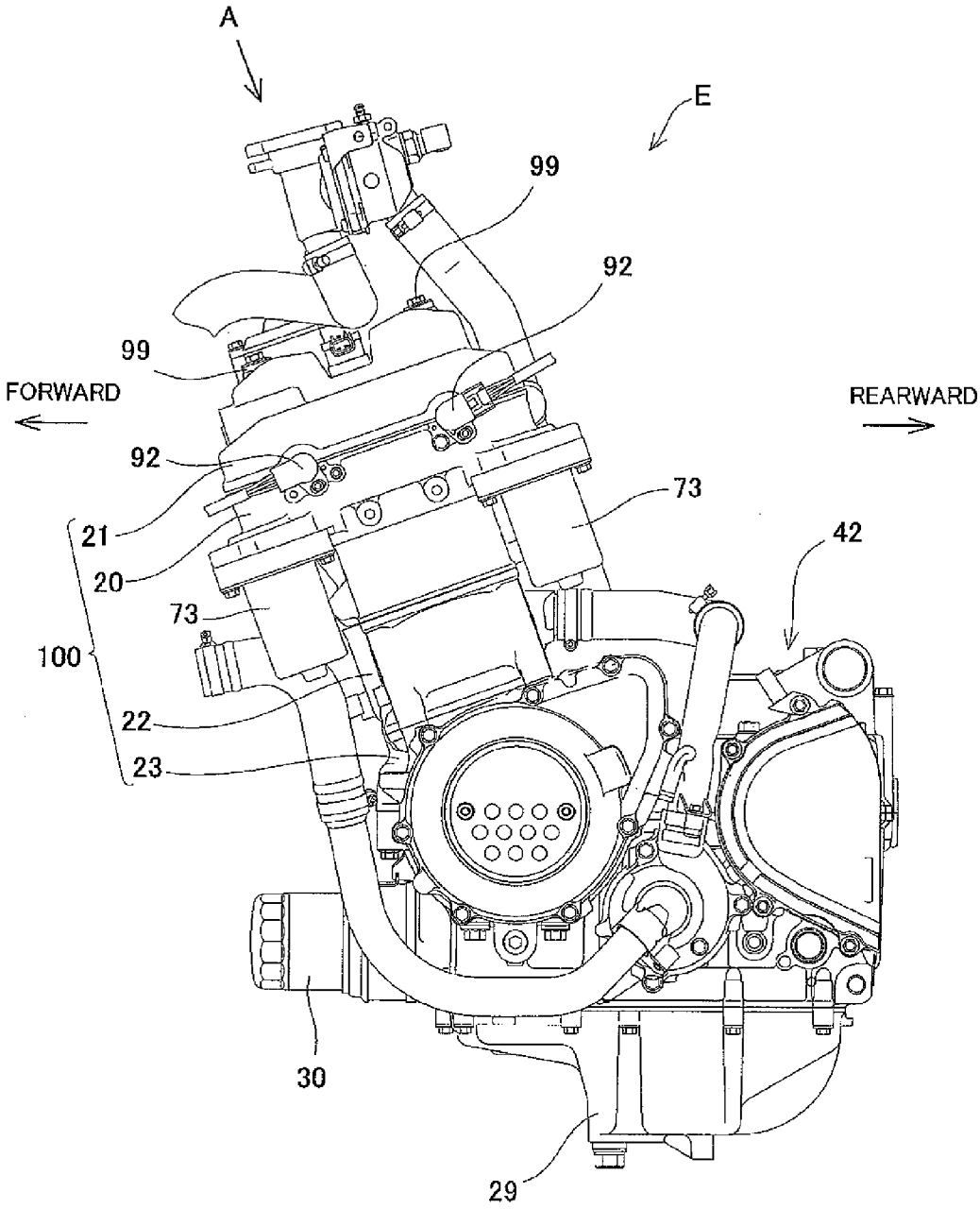
FIG. 2 is an enlarged left side view of the engine of FIG. 1.
Figure 3:
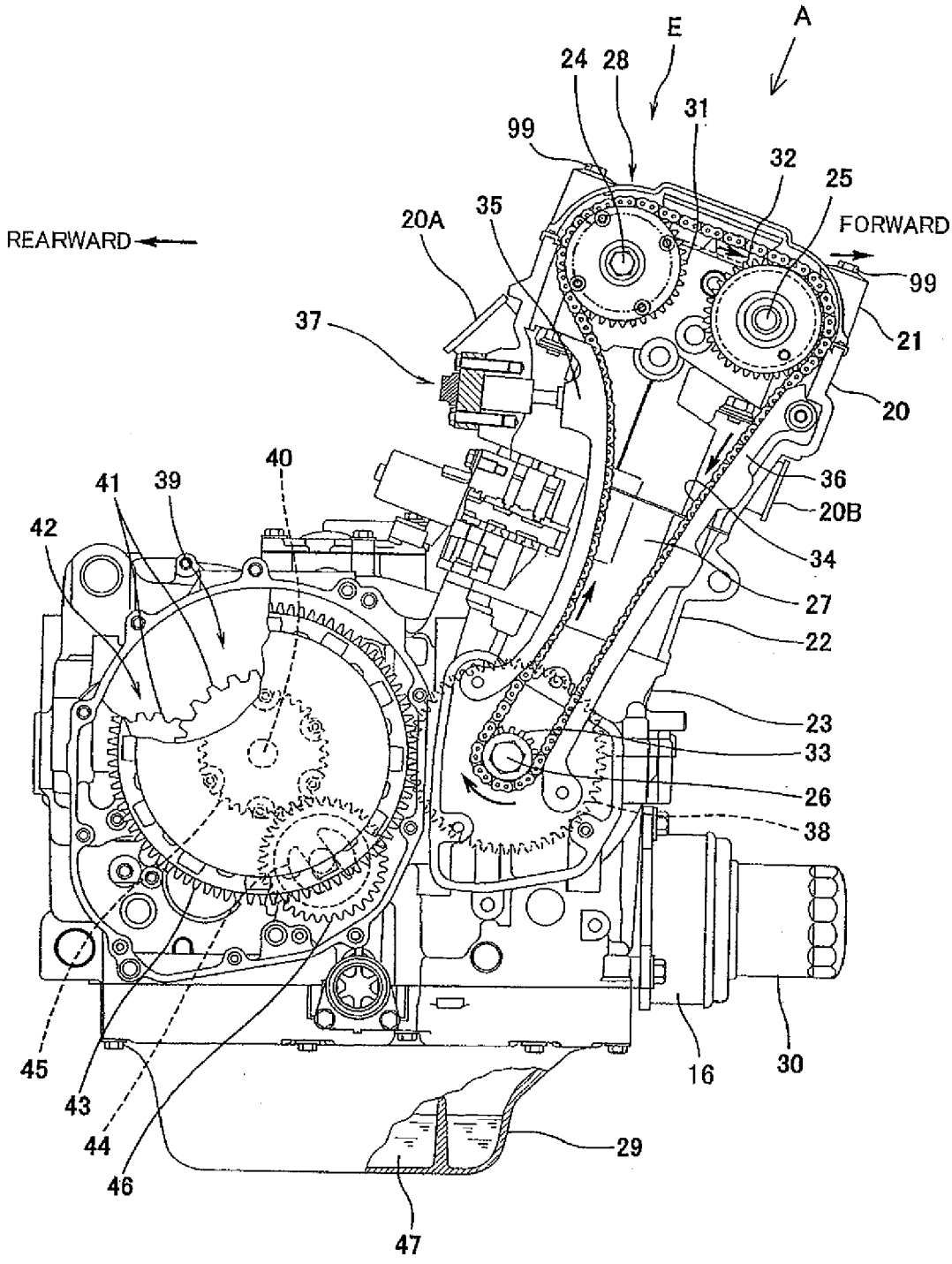
FIG. 3 is an enlarged right side view of the engine of FIG. 1, which is partly in cross-section.

FIG. 2 is an enlarged left side view of the engine E of FIG. 1. FIG. 3 is an enlarged right side view of the engine E of FIG. 1, which is partly in cross-section. As shown in FIGS. 2 and 3, the engine E includes a casing 100 including a cylinder head 20, a cylinder head cover 21, a cylinder block 22, and a crankcase 23. The engine E is an inline four-cylinder double overhead camshaft (DOHC) engine. An air-intake port 20A is provided on the rear portion of the cylinder head 20 to correspond to each cylinder and to open obliquely rearward. An exhaust port 20B is provided on the front portion of the cylinder head 20 to correspond to each cylinder and to open forward. An intake-side drive camshaft 24 and an exhaust-side drive camshaft 25 are arranged in an upper portion of the cylinder head 20 of the engine E in a vehicle width direction (rightward and leftward direction). The drive camshafts 24 and 25 are rotatably retained by shaft support bodies 49 (see FIG. 4). The cylinder head cover 21 is provided over the support shaft bodies 49 and is fastened to the cylinder head 20.

A plurality of combustion chambers 52 (see FIG. 4) are arranged at the lower portion of the cylinder head 20 in the vehicle width direction, and cylinder blocks 22 respectively accommodating a plurality of pistons (not shown) are respectively connected to the plurality of combustion chambers 52. The crankcase 23 accommodating a crankshaft 26 extending in the vehicle width direction is connected to the lower portion of the cylinder blocks 22. As shown in FIG. 3, in a right wall portion (one end portion in the vehicle width direction) of the casing 100 which is formed by the cylinder head 20, the cylinder head cover 21, the cylinder block 22, and the crankcase 23, a chain tunnel 27 is formed to extend from the interior of the cylinder head 20 to the interior of the crankcase 23. In the chain tunnel 27, a part of a driving power transmission mechanism 28 for transmitting a rotational driving power of the crankshaft 26 to the drive camshafts 24 and 25 is accommodated. An oil pan 29 for reserving oil for lubrication or hydraulically-powered devices is provided at the lower portion of the crankcase 23. An oil cooler 16 for cooling oil suctioned up from the oil pan 29 and an oil filter 30 for filtering the oil are provided at the front portion of the crankcase 23.

The driving power transmission mechanism 28 includes an intake cam sprocket 31, an exhaust cam sprocket 32, a crank sprocket 33, and a timing chain 34. To be specific, the right end portion of the intake-side drive camshaft 24 protrudes into the chain tunnel 27, and the intake cam sprocket 31 is provided at the end portion. The right end portion of the exhaust-side drive camshaft 25 protrudes into the chain tunnel 27, and the exhaust cam sprocket 32 is provided at the end portion. Furthermore, the right end portion of the crankshaft 26 protrudes into the chain tunnel 27, and the crank sprocket 33 is provided at the end portion.

The timing chain 34 is installed around the intake cam sprocket 31, the exhaust cam sprocket 32, and the crank sprocket 33. When the crank sprocket 33 rotates, the intake cam sprocket 31 and the exhaust cam sprocket 32 rotate in association with the rotation of the crank sprocket 33. Therefore, through the driving power transmission mechanism 28 formed by the intake cam sprocket 31, the exhaust cam sprocket 32, the crank sprocket 33 and the timing chain 34, the rotational driving power of the crankshaft 26 is transmitted to the drive camshafts 24 and 25.

Inside the chain tunnel 27, a movable chain guide 35 and a fixed chain guide 36 are provided. The fixed chain guide 36 extends vertically in front of the timing chain 34 and from a location in front of and in the vicinity of the crank sprocket 33 to a location under and in the vicinity of the exhaust cam sprocket 32.

The movable chain guide 35 extends vertically behind the timing chain 34. The movable chain guide 35 is mounted at a lower end portion thereof to the right wall portion of the crankcase 23 at a location above and in the vicinity of the crank sprocket 33. An upper end portion of the movable chain guide 35 is located under and in the vicinity of the intake cam sprocket 31. A hydraulically-powered tensioner 37 mounted to the rear wall portion of the cylinder head 20 causes the movable chain guide 35 to apply a force from behind to the timing chain 34 to make the timing chain 34 have a suitable tension.

An output gear 38 configured to output the rotation of the crankshaft 26 is mounted on the right portion of the crankshaft 26 such that the output gear 38 is rotatable integrally with the crankshaft 26. A transmission chamber 39 is formed in the rear portion of the crankcase 23, and accommodates therein an input shaft 40 and an output shaft (not shown) such that the input shaft 40 and the output shaft (not shown) extend substantially in parallel with the crankshaft 26. A plurality of gears 41 are mounted on the input shaft 40 and the output shaft to form a transmission 42. An input gear 43 is mounted on the right end portion of the input shaft 40 such that the input gear 43 is configured to mesh with the output gear 38 of the crankshaft 26 and is rotatable integrally with the input shaft 40. Therefore, the driving power of the engine E is transmitted from the crankshaft 26 to the input shaft 40 via the output gear 38 and the input gear 43, and its rotational speed is changed by the transmission 42. The resulting driving power is output to the rear wheel 3 (FIG. 1).

The engine E includes a trochoidal rotor type oil pump 44. The oil pump 44 includes a pump driven gear 46 which is configured to mesh with a pump drive gear 45 mounted on the input shaft 40 of the transmission 42. According to the rotation of the crankshaft 26, the oil pump 44 is driven. The engine E is provided with lubricating or hydraulic oil passages to deliver oil 47 suctioned up by the oil pump 44 from the oil pan 29 to engine components.

Figure 4:
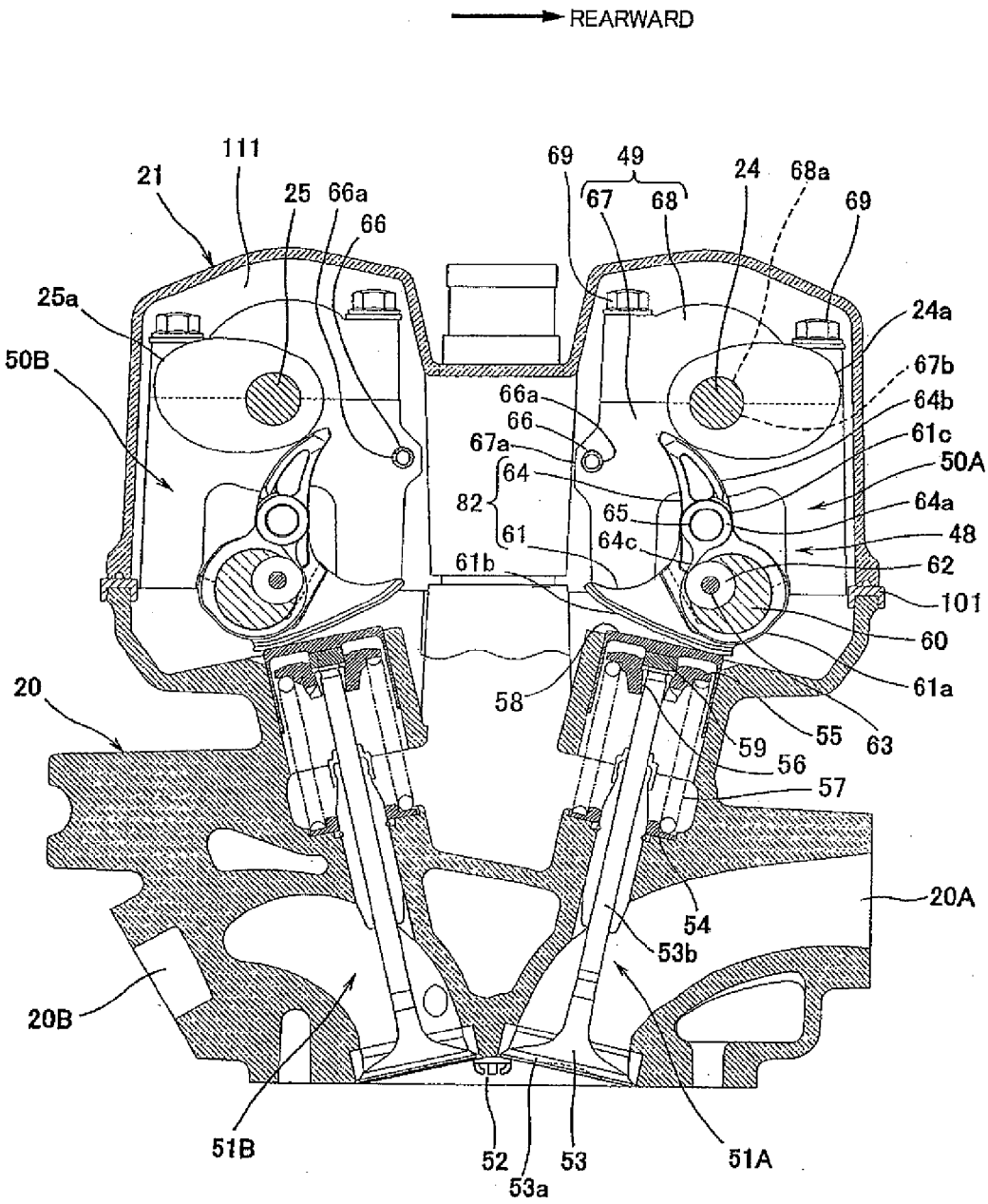
FIG. 4 is an enlarged cross-sectional view of valve operating systems and others when the engine of FIG. 1 is seen from the side.
Figure 5:
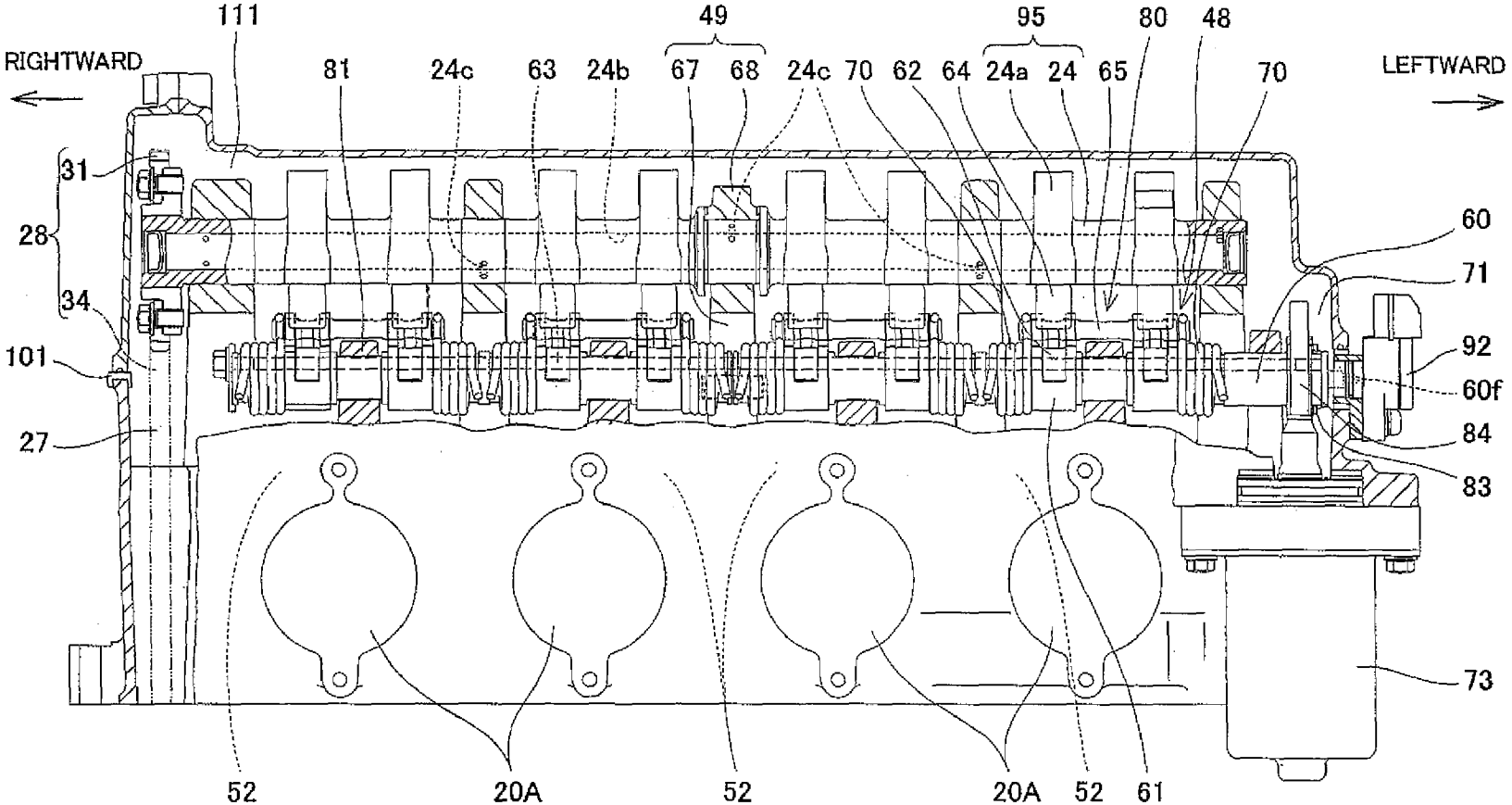
FIG. 5 is a cross-sectional view of valve operating systems and others when the engine E of FIG. 1 is seen from the rear.

FIG. 4 is an enlarged cross-sectional view of valve operating systems 50A and 50B and others when the engine E of FIG. 1 is seen from the side. FIG. 5 is a cross-sectional view of the valve operating system 50A and others when the engine E of FIG. 1 is seen from the rear. In the cylinder head 20, four combustion chambers 52 are arranged in one line in the rightward and leftward direction. The intake valve mechanism 51A and the exhaust valve mechanism 51B are provided at the upper portion of the cylinder head 20 to protrude upward at front and rear sides of each of the four combustion chambers 52. The intake-side valve operating system 50A causes the intake valve mechanism 51A to perform an opening and closing operation (reciprocating operation) to open or close the intake port 20A, while the exhaust-side valve operating system 50B causes the exhaust valve mechanism 51B to perform an opening and closing operation (reciprocating operation) to open or close the exhaust port 20B. Since the intake valve mechanism 51A and the exhaust valve mechanism 51B have substantially the same structure and the intake-side valve operating system 50A and the exhaust-side valve operating system 50B have substantially the same structure, the intake valve mechanism 51A and the intake-side valve operating system 50A will be described, but description for the exhaust valve mechanism 51B and the exhaust-side valve operating system 50B will be omitted.

The intake valve mechanism 51A includes a valve body 53 which is an intake-side valve. The valve body 53 includes a flange portion 53*a* used for opening and closing the intake port 20A, and a stem portion 53*b* extending upward from the flange portion 53*a*. The stem portion 53*b* is provided with a groove at an upper end portion thereof. A cotter 56 is inserted into the groove of the stem portion 53*b*. A spring retainer 55 is mounted to the cotter 56. A spring seat 54 is mounted to the upper surface of the intake port 20A. A valve spring 57 is mounted between the spring seat 54 and the spring retainer 55. The valve spring 57 applies an upward force to the valve body 53 to close the intake port 20A. A tappet 58 is attached to the upper end of the valve body 53 with a shim 59 interposed therebetween.

The valve operating system 50A includes a drive cam mechanism 95 including the drive camshaft 24 configured to operate in association with the rotation of the crankshaft 26 of the engine E and a drive cam 24*a* fixed to the drive camshaft 24, and a pivot cam mechanism 48 configured to contact the drive cam 24*a* to transmit the movement of the drive cam 24*a* to the tappet 58 of the intake valve mechanism 51A. The drive cam 24*a* has a substantially cylindrical shape with an oval cross section and extends coaxially with the camshaft 24. A distance between the rotation center of the camshaft 24 and the outer peripheral surface of drive cam 24*a* changes in a direction around the rotational axis.

Figure 6:
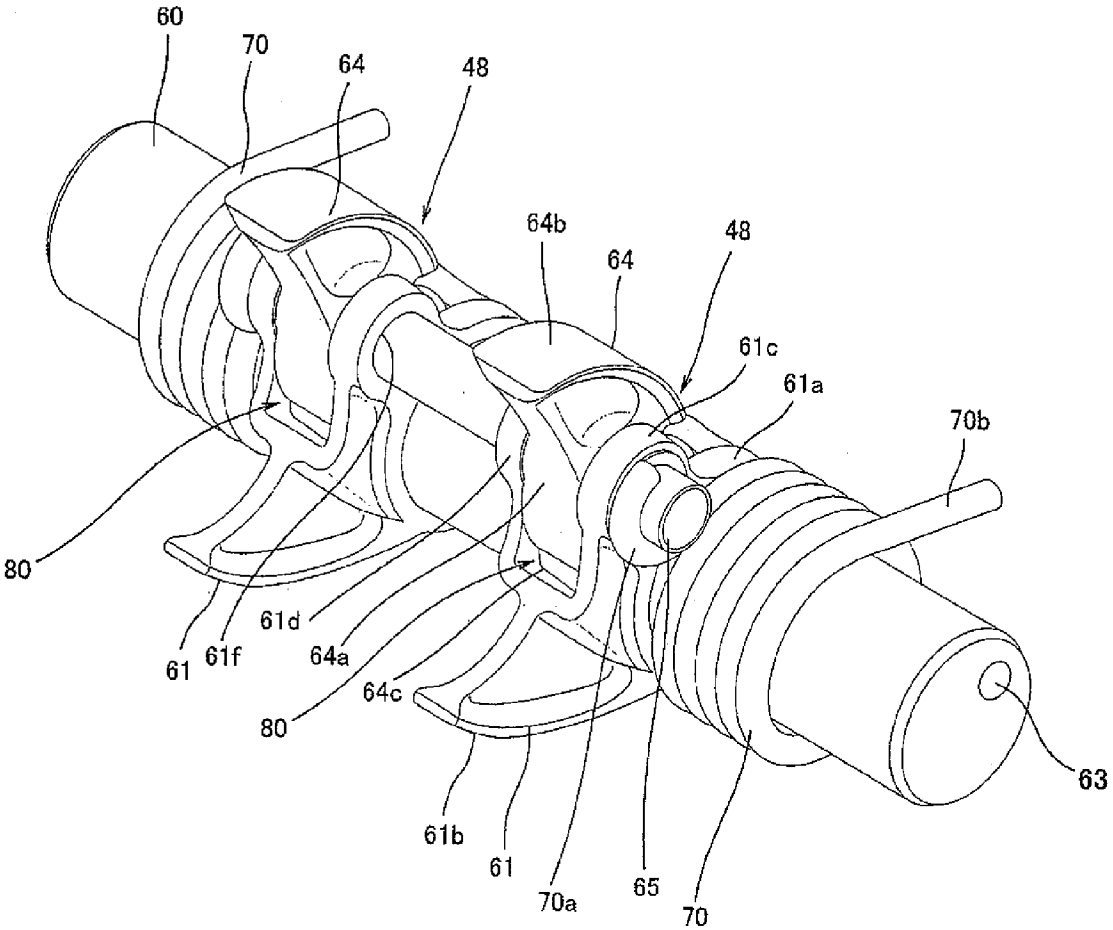
FIG. 6 is a perspective view of major components of a pivot cam mechanism of the valve operating systems of FIGS. 4 and 5.
Figure 7:
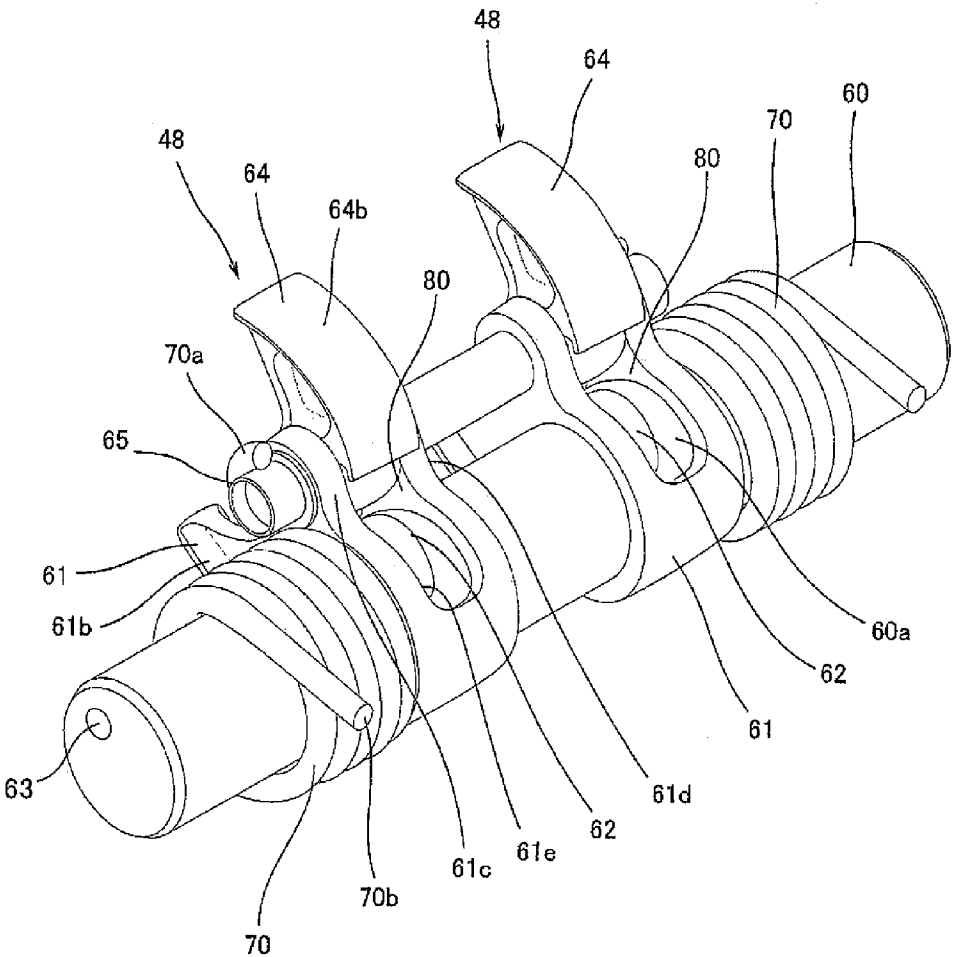
FIG. 7 is a perspective view of major components of the pivot cam mechanism of FIG. 6, as viewed from another angle.

FIG. 6 is a perspective view of major components of the pivot cam mechanism 48 of FIGS. 4 and 5. FIG. 7 is a perspective view of major components of the pivot cam mechanism 48 of FIG. 6, as viewed from another angle. As shown in FIGS. 4 to 7, the pivot cam mechanism 48 includes a pivot cam 82 and a relative position changing mechanism 80. The pivot cam 82 includes a driven member 64 configured to contact the drive cam 24*a*, and a pivot member 61 which is mounted to the driven member 64 and is configured to press the tappet 58 of the intake valve mechanism 51A. The relative position changing mechanism 80 is configured to change the phase between the driven member 64 and the pivot member 61. To be specific, the relative position changing mechanism 80 includes a control shaft 60 configured to support the pivot member 61 such that the pivot member 61 is pivotable, a coupling pin 65 coupling the driven member 64 to the pivot member 61 such that the driven member 64 is angularly displaceable with respect to the pivot member 61, a roller 62 which is provided at a part of the control shaft 60 and is configured to support the driven member 64 against a force from the drive cam 24*a*, and a driven member spring 70 configured to apply a force to cause the driven member 64 to move toward the drive cam 24*a*.

The pivot member 61 has a ring-shaped portion 61*a* which is rotatably and externally fitted to the control shaft 60. A claw-shaped pivot portion 61*b* protruding toward the exhaust valve mechanism 51B is provided at a lower portion of the ring-shaped portion 61*a*. The pivot portion 61*b* has a substantially sector shape to form a pivot portion sliding surface of a substantially circular-arc shape and protrudes radially outward from the ring-shaped portion 61*a*. The pivot portion sliding surface extends along a flat plane perpendicular to the axis of the ring-shaped portion 61*a*. A distance between the pivot portion sliding surface and the center of the ring-shaped portion 61*a* changes in the direction from one end portion of the sliding surface to an opposite end portion of the sliding surface. A cut portion 61*e* is formed on the upper portion of the ring-shaped portion 61*a* so as to extend in a circumferential direction of the ring-shaped portion 61*a*. A pair of pin support portions 61*c* and 61*d* are provided at both sides of the cut portion 61*e* in the ring-shaped portion 61*a* to be oriented upward and substantially toward the exhaust valve mechanism 51B. A through-hole 61*f* into which the coupling pin 65 is inserted is formed in the pin support portions 61*c* and 61*d*. Therefore, the pin support portions 61*c* and 61*d* are integrally fastened to the ring-shaped portion 61*a*, and the through-hole 61*f* of the pin support portions 61*c* and 61*d* is positioned closer to the center of a virtual circle including the pivot portion sliding surface. The pin support portions 61*c* and 61*d* support the driven member 64 via the coupling pin 65 such that the driven member 64 is angularly displaceable around the axis of the through-hole 61*f*. The axis of the roller 62 is positioned in a location which is eccentric from the axis of the control shaft 60. The roller 62 partially protrudes radially outward from the control shaft 60. The roller 62 is loosely fitted in the cut portion 60*a* of the pivot member 61 so that the control shaft 60 is angularly displaceable around the center of the driven member 64.

The driven member 64 has a ring-shaped support portion 64*a* into which the coupling pin 65 is inserted. A claw-shaped driven portion 64*b* protrudes upward and substantially toward the exhaust valve mechanism 5B from the support portion 64*a*. The driven portion 64*b* has a substantially sector shape to form a driven portion sliding surface of a substantially circular-arc shape, and protrudes radially outward from the support portion 64*a*. The driven portion sliding surface extends along a flat plane perpendicular to the axis of the support portion 64*a*. A distance between the driven portion sliding surface and the center of the support portion 64*a* changes in the direction from one end portion of the sliding surface to an opposite end portion of the sliding surface.

A lever portion 64*c* protrudes downward from the support portion 64*a* and is configured to contact the roller 62. The lever portion 64*c* is disposed loosely in a cut space of the cut portion 61*e* of the pivot member 61. When the lever portion 64*c* contacts the roller 62, further angular displacement of the driven member 64 around the pin support portions 61*c* and

61*d* is restricted after the contact. The coil-shaped driven member spring 70 is externally fitted to the control shaft 60. One end portion 70*a* of the driven member spring 70 is wound around the coupling pin 65, and an opposite end portion 70*b* thereof extends in a direction opposite to the direction in which the one end portion 70*a* extends. The opposite end portion 70*b* of the driven member spring 70 is sandwiched and retained between the lower surface of a lower bearing recess 67*b* to be described later and the upper surface of the cylinder head 20.

A cut portion 60*a* is formed on the control shaft 60 in a position corresponding to the driven member 64. The roller 62 is disposed in the cut portion 60*a*. The roller 62 is rotatably supported by a roller shaft 63 axially penetrating through the inside of the control shaft 60. When the control shaft 60 rotates, the position of the roller 62 changes, changing a contact position of the lever portion 64*c* of the driven member 64 with respect to the roller 62. Thereby, the relative positions of the driven member 64 and the pivot member 61 are changed around the coupling pin 65. In other words, according to the angular displacement of the control shaft 60, the position around the axis of the control shaft 60 where the angular displacement of the driven member 64 is restricted is changed. On the other hand, irrespective of the angular displacement of the control shaft 60, the position around the axis of the control shaft 60 where the pivot member 61 is angularly displaced, is not changed. As a result, according to the angular displacement of the control shaft 60, a relative position relationship in the circumferential direction of the control shaft 60 between the pivot member 61 and the driven member 64 is changed.

As shown in FIGS. 4 and 5, the shaft support body 49 is provided on the upper surface of the cylinder head 20 and is configured to rotatably support the drive camshaft 24. The shaft support body 49 includes a lower support member 67 protruding from the upper surface of the cylinder head 20, and an upper support member 68 mounted to the lower support member 67 from above by bolts 69. The lower support member 67 has a lower bearing recess 67*b* having a semicircular cross-section. The upper support member 68 has an upper bearing recess 68*a* having a semicircular cross-section which is opposite to the lower bearing recess 67*b*. The drive camshaft 24 is rotatably inserted into a space which is defined by the lower bearing recess 67*b* and the upper bearing recess 68*b* and has a circular cross-section.

The drive camshaft 24 inserted as described above has a hollow cylinder shape, and is provided therein with an oil passage 24*b* in which the oil flows. A plurality of outlets 24*c* are formed on the peripheral wall of the drive camshaft 24 such that they are spaced apart from each other in an axial direction thereof. Through the outlets 24*c*, the oil is ejected. The outlets 24*c* are provided at locations corresponding to the lower bearing recess 67*b* and the upper bearing recess 68*a* and are configured to eject the oil toward the lower bearing recess 67*b* and the upper bearing recess 68*a*.

The lower support member 67 has an insertion hole 67*a* penetrating therethrough in an axial direction of the drive camshaft 24. An oil pipe 66 is inserted into the insertion hole 67*a*. That is, a pair of oil pipes 66 are provided between the intake-side valve operating system 50A and the exhaust-side valve operating system 50B. A plurality of outlets 66*a* open on the peripheral wall of the oil pipe 66 such that they are spaced apart from each other in an axial direction of the oil pipe 66.

The outlets 66*a* are provided in locations corresponding to the valve operating system 50A such that they are spaced apart from each other in the axial direction of the oil pipe 66. Through the outlets 66*a*, the oil flowing within the oil pipe 66 is ejected toward the valve operating system 50A.

The outlets 66*a* of the oil pipe 66 are located closer to a tip end portion of the claw-shaped driven portion 64*b* of the driven member 64. To be specific, the oil pipe 66 for the intake valve mechanism 51A is disposed in a center space formed between the intake valve mechanism 51A and the exhaust valve mechanism 51B. The outlets 66*a* of the oil pipe 66 are oriented to face sliding surfaces which are the contact surfaces of the driven portion 64*b* of the driven member 64 and the drive cam 24*a* which are slidable relative to each other in at least a position of a movable range of the pivot cam mechanism 48.

Figure 8:
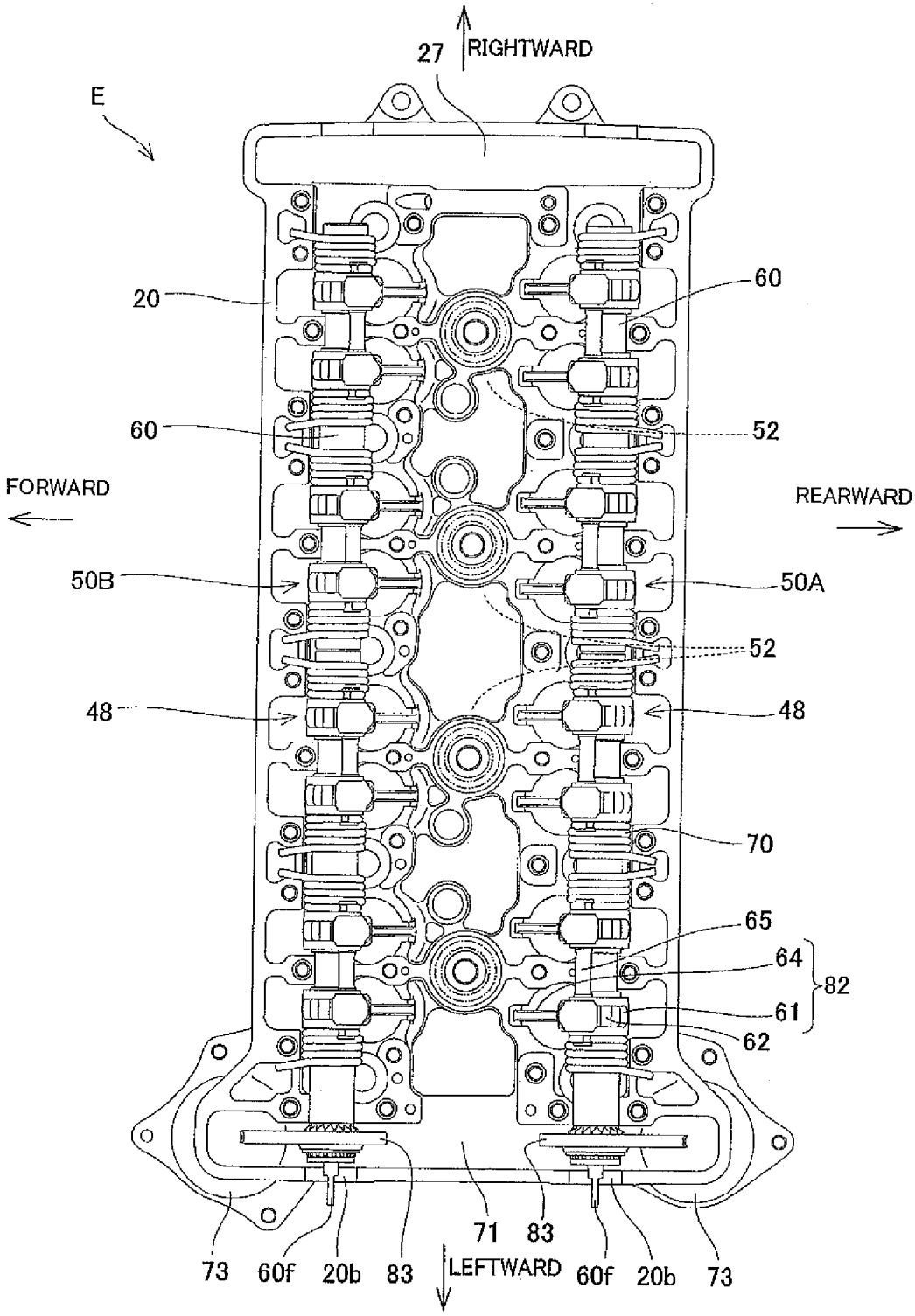
FIG. 8 is a plan view of the engine of FIG. 3, from which a cylinder head cover, shaft support members, and drive camshafts are removed.
Figure 9:
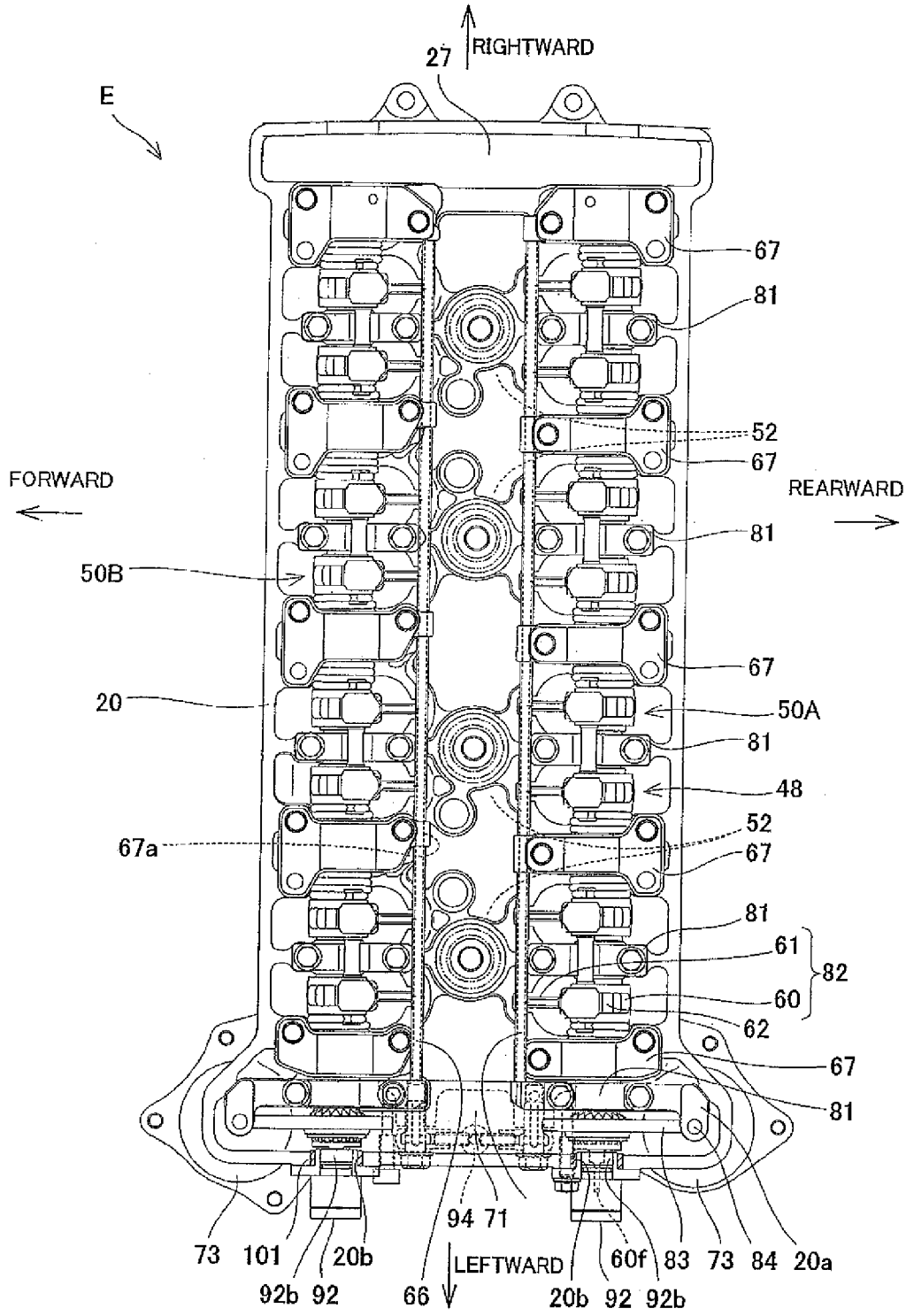
FIG. 9 is a plan view showing a state where lower support members are mounted to the engine E in the state of FIG. 8.
Figure 10:
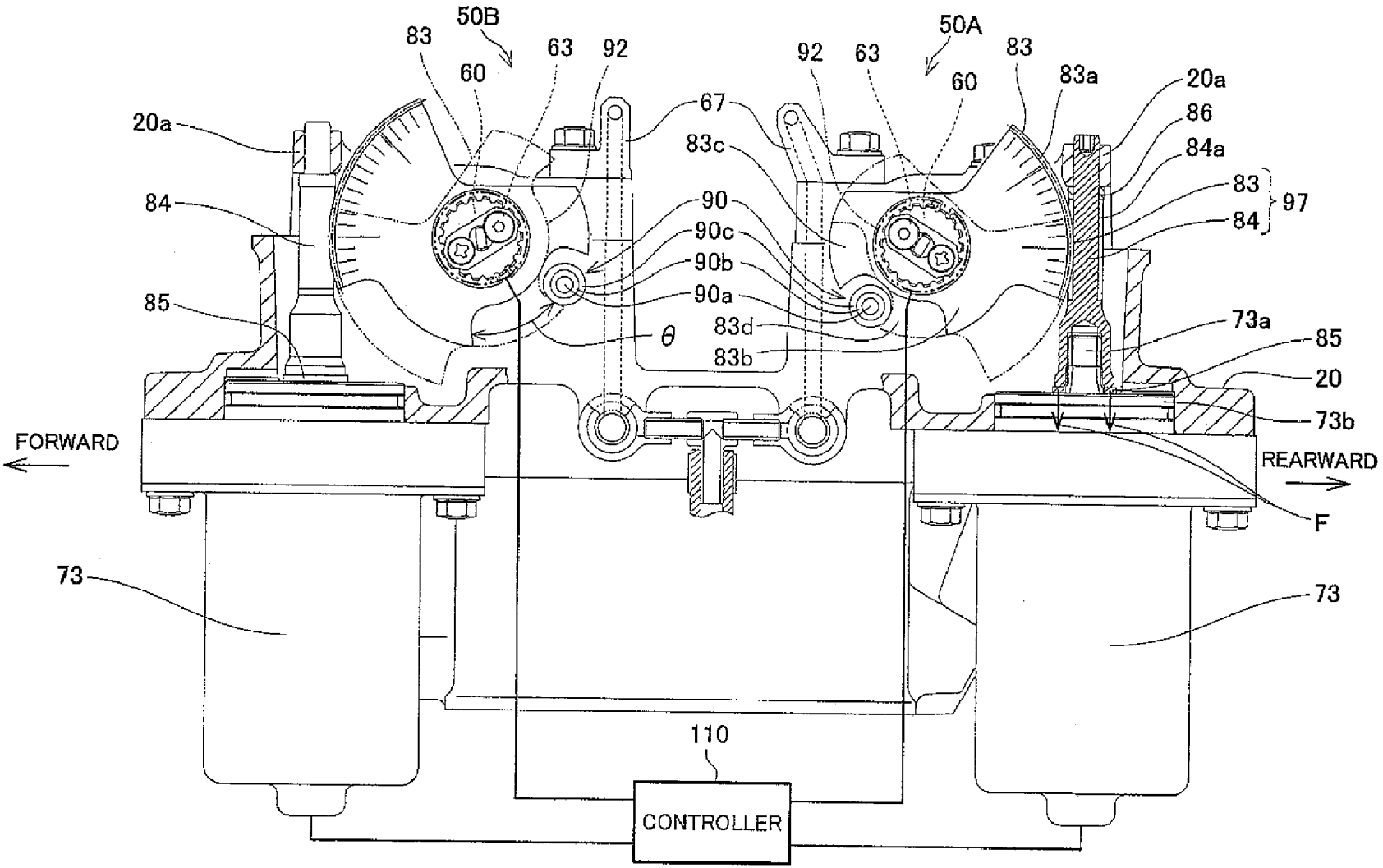
FIG. 10 is a left side view of the engine E of FIG. 9, as viewed from below the drawing sheet.
Figure 11:
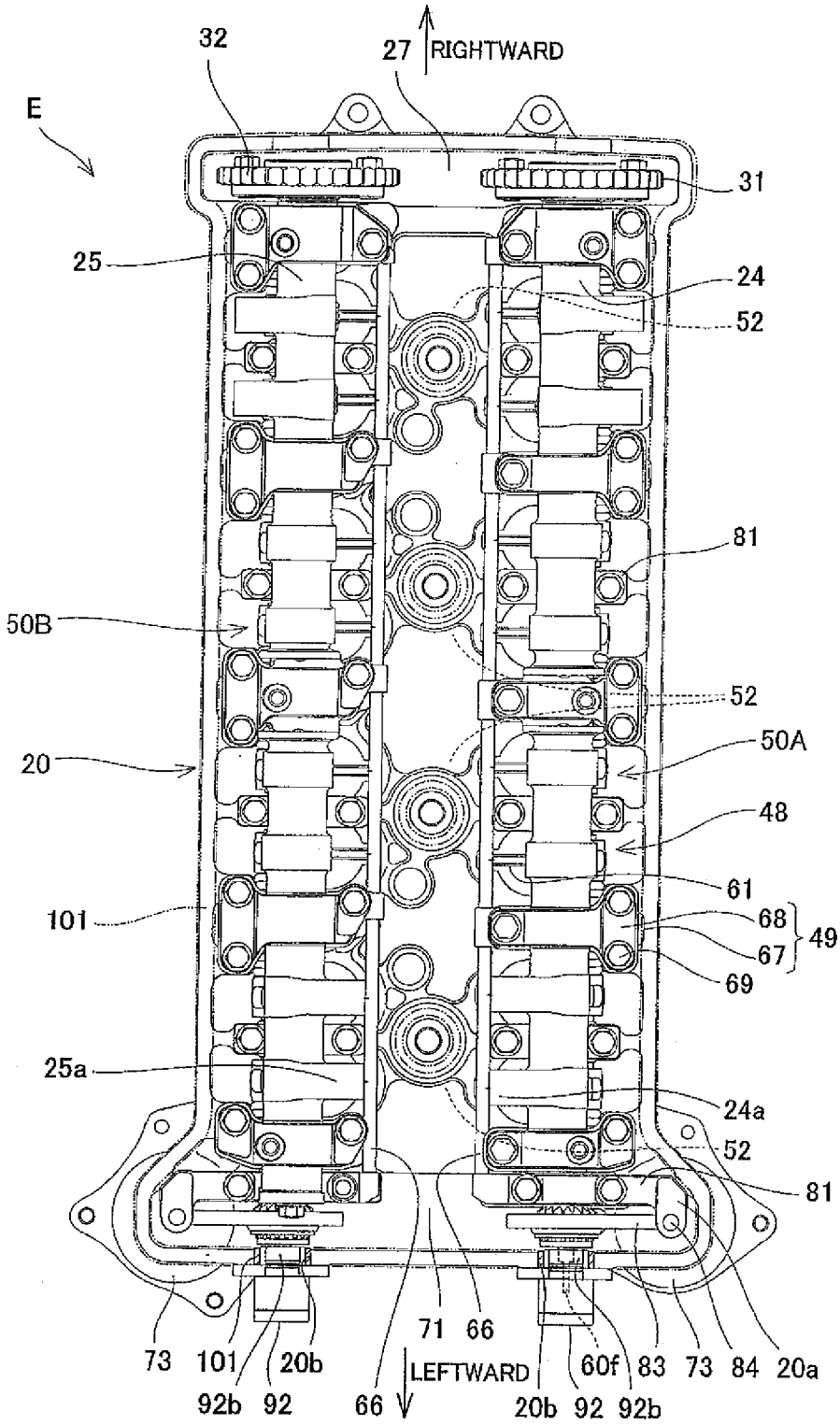
FIG. 11 is a plan view showing a state where upper support members and drive camshafts are mounted to the engine E in the state of FIG. 10.
Figure 12:
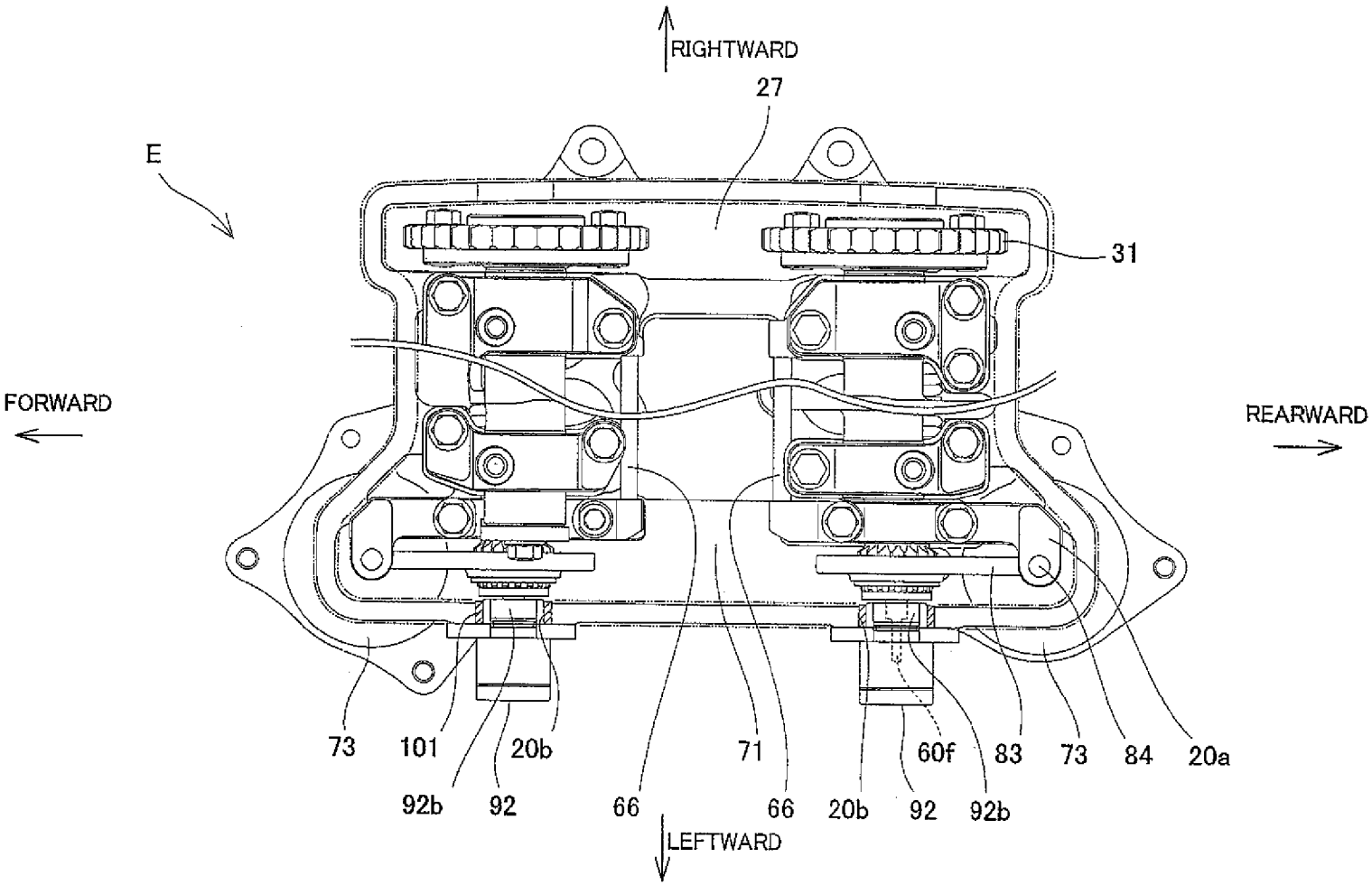
FIG. 12 is a partially enlarged view of the engine E of FIG. 11.

FIG. 8 is a plan view of the engine E of FIG. 3, from which the cylinder head cover 21, the shaft support bodies 49 and the drive camshafts 24 and 25 are removed. FIG. 9 is a plan view showing a state where the lower support members 67 are mounted to the engine E of FIG. 8. FIG. 10 is a left side view of the engine E of FIG. 9, as viewed from below the drawing sheet. FIG. 11 is a plan view showing a state where the upper support members 68 and the drive camshafts 24 and 25 are mounted to the engine E in the state of FIG. 10. FIG. 12 is a partially enlarged view of the engine E of FIG. 11. Hereinafter, the description will be given with reference to FIGS. 4 and 5 as well as these figures. As shown in FIG. 8, the valve operating system 50A for air-intake is aligned on one side relative to four combustion chambers 52 arranged in one line, while the valve operating system 50B for air-exhaust is aligned on the other side relative to the four combustion chambers 52.

In more detail, as shown in FIG. 8, the pivot cam mechanisms 48 are arranged to extend at the upper surface of the cylinder head 20 along the direction in which the combustion chambers 52 are arranged such that the pivot cam mechanisms 48 are spaced apart from each other in a forward and rearward direction. As shown in FIG. 10, the plurality of lower support members 67 and the plurality of support members 81 are arranged along the direction in which the combustion chambers 52 are arranged at both sides in the forward and rearward direction at the upper surface of the cylinder head 20. The plurality of lower support members 67 are disposed at locations respectively corresponding to the driven member springs 70 provided at the control shafts 60, and the support members 81 are each disposed between adjacent lower support members 67 and between adjacent pivot cams 82. The plurality of support members 81 have lower surfaces having semi-circular cross-sections. The control shaft 60 is rotatably retained between the lower surface of each support member 81 and the upper surface of the cylinder head 20.

The drive camshafts 24 and 25 are disposed on the plurality of lower support members 67 so as to extend along the direction in which the combustion chambers 52 are arranged, and the upper support members 68 are fastened thereon by bolts 69, as shown in FIG. 11. In this structure, as shown in FIG. 4, the drive camshafts 24 and 25 are each rotatably supported by the lower bearing recess 67*b* and the upper bearing recess 68*a*. As shown in FIG. 3, the right end portions of the drive camshafts 24 and 25 disposed in this manner are respectively coupled to the cam sprockets 31 and 32 inside the chain tunnel 27.

As shown in FIG. 5, FIG. 12, and the like, a gear chamber 71 is provided at an end portion of the casing 100 (FIG. 2) which is located at the opposite side of the chain tunnel 27. The control shaft 60 penetrates through the gear chamber 71 to the left side of the casing 100. A protruding member 60*f* (axial one end portion) is provided at a left end portion of the control shaft 60 so as to protrude to the left from the casing 100. An angle sensor 92 (displacement detecting means) is attached on the protruding member 60*f* and is configured to detect a rotational angle (simply expressed as the rotational angle of the control shaft 60 in some cases) around the axis of the control shaft 60. A worm wheel 83 is disposed in the gear chamber 71 and fastened in the vicinity of the left end portion of the control shaft 60.

As shown in FIG. 10, the worm wheel 83 includes a gear portion 83*a* which forms a sector-shaped gear and has an axis conforming to the axis of the control shaft 60, and two restricting portions 83*b* and 83*c* extending from the gear portion 83*a* radially outward of the control shaft 60. The two restricting portions 83*b* and 83*c* are disposed at the gear portion 83*a* such that they are spaced apart from each other in the circumferential direction of the control shaft 60. Between the two restricting portions 83*b* and 83*c*, a guide groove 83*d* extends in the circumferential direction of the control shaft 60. A stopper 90 is disposed in the gear chamber 71 to inhibit the worm wheel 83 from rotating around the control shaft 60 a predetermined angle θ or larger.

The stopper 90 has a cylindrical shaft member 90*a*, a cylindrical elastic member 90*b*, and a cylindrical contact member 90*c*. The elastic member 90*b* is made of an elastic material such as synthetic resin. The shaft member 90*a* is inserted and fitted into the elastic member 90*b*. The elastic member 90*b* is fitted into the metal contact member 90*c* by press-in or printing. The stopper 90 having such a structure is disposed in the guide groove 83*d* between the two restricting portions 83*b* and 83*c*. The stopper 90 is configured to contact the restricting portion 83*b* or 83*c*, to inhibit the worm wheel 83 from rotating a predetermined angle θ or larger in one direction or an in an opposite direction around the control shaft 60 (e.g., see two-dotted line in FIG. 11). The gear portion 83*a* of the worm wheel 83 is provided in a range which is the predetermined angle θ or larger in the circumferential direction of the center axis of the worm wheel 83.

Two servo motors 73 are attached to the outer peripheral portion of the cylinder head 20 below the gear chamber 71. These servo motors 73 are provided so as to respectively correspond to the valve operating systems 50A and 50B. The servo motors 73 are electrically coupled to a controller 110 such as an ECU and are configured to drive according to a signal output from the controller. Each servo motor 73 includes a casing 73*b* and an output shaft 73*a* configured to be rotatable. The casing 73*b* has a hollow cylinder shape. The output shaft 73*a* protrudes axially from axial one end portion of the casing 73*b*. In this embodiment, the casing 73*b* forms an outer wall of the servo motor 73 and serves as a worm support member supporting the worm 84 in a thrust direction. The worm support member serves to support the output shaft 73*a* in a radial direction and in the thrust direction and is provided separately from an output shaft support member disposed inside the casing 73*b*. The output shaft 73*a* is disposed such that its axis extends in parallel with a flat plane perpendicular to the axis of the worm wheel 83. The worm 84 is spline-coupled to the output shaft 73*a*. The worm 84 is displaceable in the axial direction of the output shaft 73*a*. A washer 85 is externally mounted to the output shaft 73*a*. The washer 85 is disposed between the upper surface of the casing 73*b* of the servo motor 73 and the worm 84. The washer 85 is formed of a material which wears out more easily than the material for the casing 73*b* and the worm 84. By forming the washer 85 of the material which wear outs more easily, wear-out of the casing 73*b* and the worm 84 is prevented.

By spline-coupling the output shaft 73*a* to the worm 84, the casing 73*b* is capable of receiving a thrust load F applied to the worm 84. This makes it possible to diminish the thrust applied to the output shaft 73*a* and the output shaft support member supporting the output shaft 73*a*. As a result, the servo motor 73 can be protected. The coupling between the output shaft 73*a* and the worm 84 is not restricted to the spline-coupling. For example, a key may be formed at the output shaft 73*a* and a key groove into which the key is fittable may be formed on the inner wall of the worm 84 such that the worm 84 is displaceable in the axial direction of the output shaft 73*a*. That is, the configuration for inhibiting the relative displacement around the axes of the worm 84 and the output shaft 73*a* but permitting the axial displacement between the worm 84 and the output shaft 73*a* will suffice.

The worm 84 has a gear portion 84*a* in an intermediate axial portion thereof which is engageable with the worm wheel 83. The output shaft 73*a* is inserted into one end of the axial portion of the worm 84. The opposite end of the axial portion of the worm 84 is rotatably supported by a vertically extending support portion 20*a* which is provided to extend vertically on the upper surface of the cylinder head 20. In addition, to control a clearance between the casing 73*b* and the washer 85, a shim 86 is externally mounted between the gear portion 84*a* and the vertically extending support portion 20*a*, at the upper end side of the worm 84.

With a worm gear mechanism 97 including the worm 84 and the worm wheel 83, it is possible to transmit to the control shaft 60 the rotation of the output shaft 73*a* with a reduced speed and to control the rotation amount of the control shaft 60 with high accuracy. In the worm gear mechanism 97, since the threaded portion of the worm 84 contacts the gears of the worm wheel 83, and the axis of the worm 84 and the axis of the worm wheel 83 extend in different directions, to be precise, in directions perpendicular to each other, the worm 84 serves as a stopper for the worm wheel 83. For this reason, the worm wheel 83 does not rotate unless the servo motor 73 is driven to rotate the worm wheel 83. As a result, while the engine E is running, the undesired rotation of the control shaft 60 without driving the servo motor 73 is inhibited and hence the lift characteristics of the valve body 53 described later will not undesirably change.

Since the axis of the worm 84 and the axis of the worm wheel 83 extend in different directions, a reaction force applied from the worm wheel 83 to the worm 84 in the rotational direction of the worm 84 is reduced. For this reason, the load applied in the rotational direction to the output shaft 73*a* is reduced regardless of the angular displacement of the control shaft 60. Thus, the servo motor 73 is protected.

When the worm wheel 83 comes into contact with the stopper 90, the elastic member 90*b* of the stopper 90 is elastically deformed and the stopper 90 moves toward the direction in which the worm wheel 83 rotates. This significantly suppresses the engagement between the threaded portion of the worm 83 and the gears of the worm wheel 83. Therefore, the worm gear mechanism can function smoothly even after the angular displacement of the control shaft is inhibited.

Figure 13:
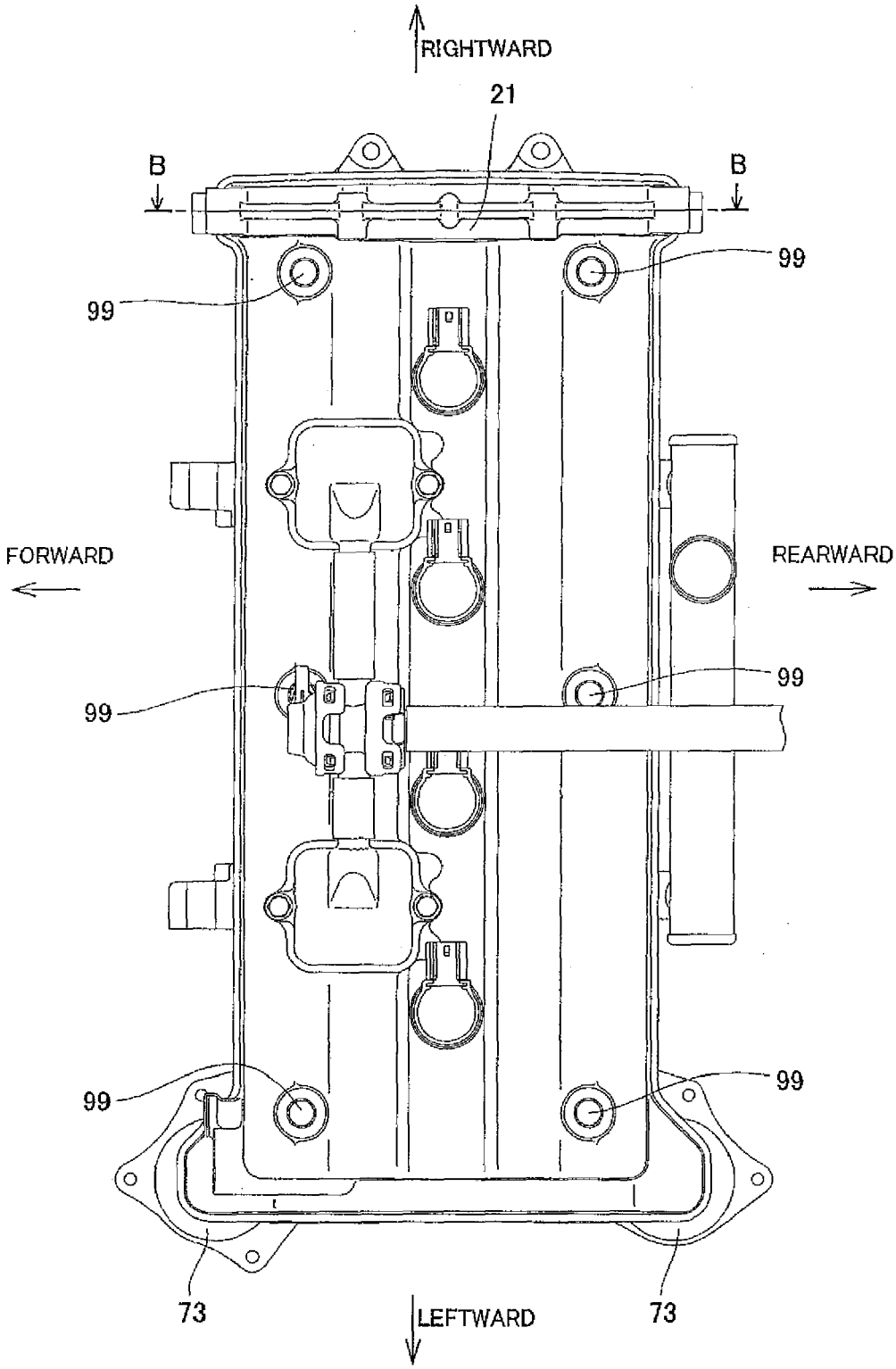
FIG. 13 is a plan view of a cylinder head and a cylinder head cover of the engine E of FIG. 2, as viewed in the direction of an arrow A of FIG. 2.

FIG. 13 is a plan view of the cylinder head 20 and the cylinder head cover 21 of the engine E of FIG. 2, as viewed in the direction of arrow A of FIG. 2. A seal member 101 having the same shape as the outer peripheral wall of the cylinder head 20 in a plan view and having a U-shaped cross-section is mounted to the outer peripheral wall of the cylinder head 20 from above as indicated by FIG. 11 (to-dotted line). Further, the cylinder head cover 21 is provided to cover the cylinder head 20 from above so that the seal member 101 is sandwiched between the upper surface of the outer peripheral wall of the cylinder head 20 and the lower surface of the outer peripheral wall of the cylinder head cover 21. The cylinder head 20 and the cylinder head cover 21 are fastened by a plurality of bolts 99.

With the above configuration, there is formed a valve operating system space 111 which is defined and closed by the cylinder head 20 and the cylinder head cover 21. In the valve operating system space 111 which is an internal space, the intake-side valve operating system 50A, the exhaust-side valve operating system 50B, the intake cam sprocket 31 and the exhaust cam sprocket 32 which protrudes upward from the upper surface of the cylinder head 20 are accommodated. The gear chamber 71 is positioned at a left end side of the valve operating system space 111. Thus, the worm 84 and the worm wheel 83 are positioned in the valve operating system space 111. Oil droplets in the valve operating system space 111 adhere to the worm 84 and the worm 83, enabling the worm gear mechanism 97 to operate smoothly.

Figure 14:
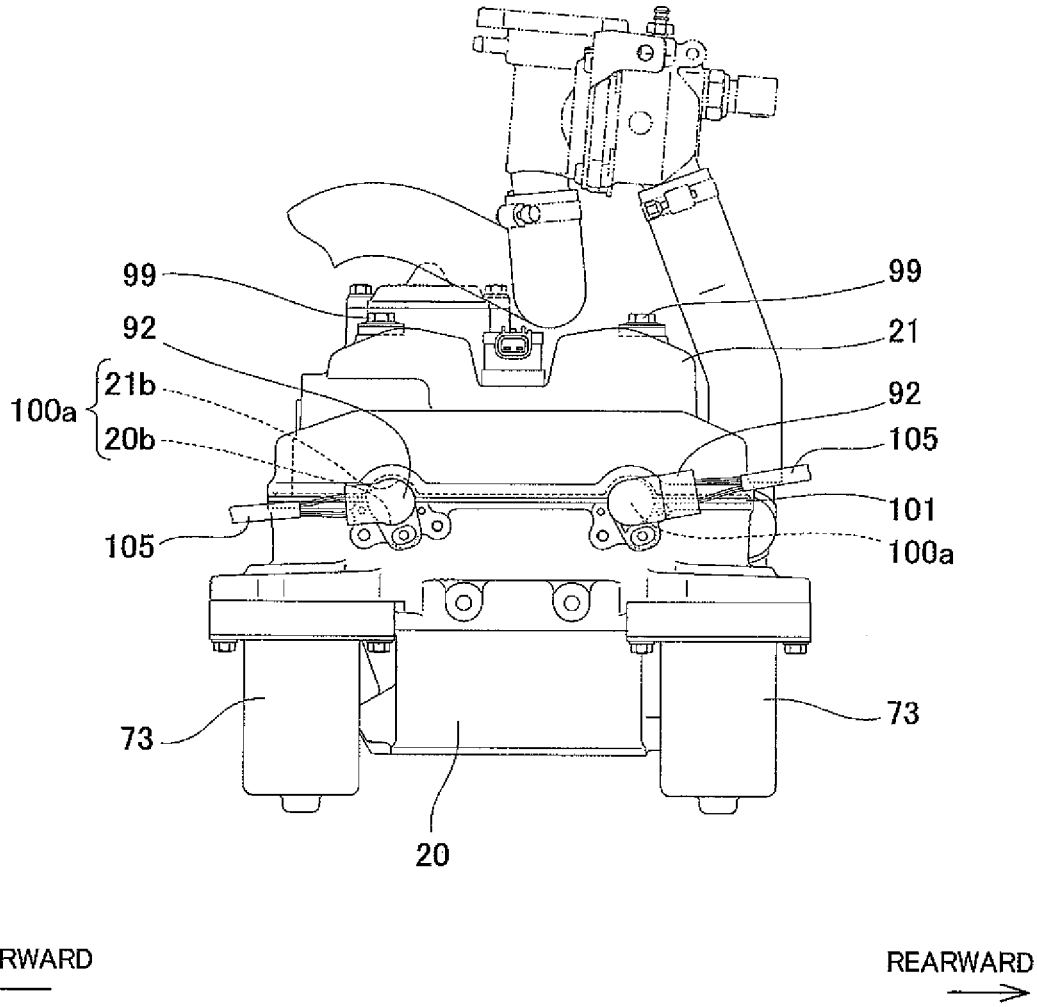
FIG. 14 is a left side view of the engine of FIG. 2, which is partly enlarged.

FIG. 14 is a left side view of the engine E of FIG. 2, a part of which is enlarged. As shown in FIGS. 9 to 12, the cylinder head 20 is provided with two recesses 20*b* having a semicircular cross section on the upper surface of the outer peripheral wall (left side wall) which is opposite to the outer peripheral wall in which the chain tunnel 27 is formed. The cylinder head cover 21 is provided on the outer wall (left side wall) with two recesses 21*b* in locations respectively corresponding to the recesses 20*b*. The recesses 20*b* and 21*b* are disposed to face each other. The recesses 20*b* and 21*b* form a through-hole 100*a* through which the outside and inside of the casing 100 communicate with each other. The protruding member 60*f* (see FIG. 10 and other figures) at the left end portion of the control shaft 60 is inserted into the through-hole 100*a* and thereby the tip end portion of the protruding member 60*f* protrudes to outside the casing 100. The angle sensor 92 is externally attached on the protruding member 60*f*, and an insertion portion 92*b* of the angle sensor 92 is inserted into the through-hole 100*a*. The seal member 101 is provided between the through-hole 100*a* and the insertion portion 92*b* of the angle sensor 92 over the entire circumference of the through-hole 100*a* to seal the through-hole 100*a* and the angle sensor 92.

With the above configuration, the angle sensor 92 can be directly attached on the control shaft 60 in the state where the oil inside the casing 100 does not adhere to the angle sensor 92. This improves detecting accuracy of the rotational angle of the control shaft 60. In addition, the seal member 101 serves to lessen the vibration of the casing 100 which would be transmitted to the angle sensor 92. This also improves detecting accuracy of the rotational angle of the control shaft 60.

The angle sensor 92 attached on the protruding member 60*f* in the above described manner is fastened to the outer peripheral surface of the casing 100, to be precise, the outer peripheral surface of the cylinder head 20 by fastener members such as bolts. A signal line 105 of the angle sensor 92 is electrically coupled to the controller. Since the angle sensor 92 is positioned outside the casing 100, the signal line 105 is not exposed to any oil and others. Thus, high seal function is attained.

Figure 15:
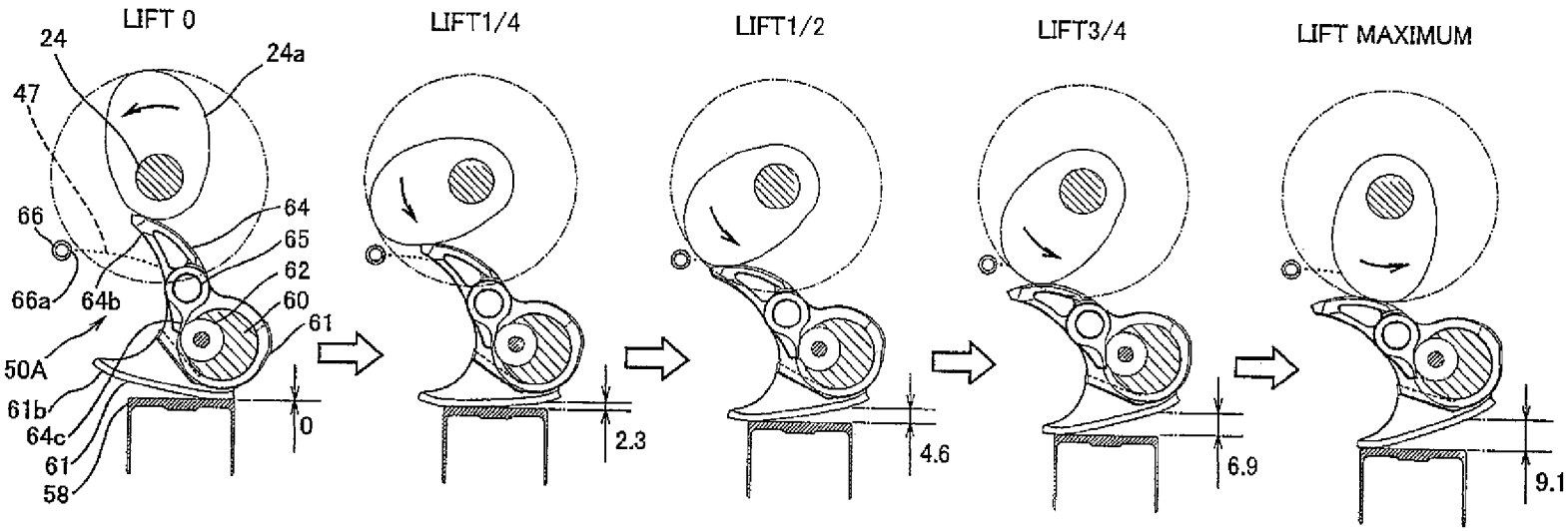
FIG. 15 is a view showing the operation of the valve operating system of FIG. 4, in a normal state.

Subsequently, an operation principle of the pivot cam mechanism 48 will be described. FIG. 15 is a view showing a normal operation of the valve operating system 50A of FIG. 4. As shown in FIG. 15, at a time point when the tip end portion of the drive cam 24*a* is located at an upper limit position, i.e., a lift amount is zero, the driven member 64 is applied with a force from the driven member spring 70 (see FIG. 4) via the coupling pin 65 so that the driven member 64 is pressed against the drive cam 24*a*. In this case, since the lever portion 64*c* of the driven member 64 is in contact with the roller 62, the driven member 64 rotates around the coupling pin 65, inhibiting the driven portion 64*b* from being closer to the pivot portion 61*b*.

When the drive cam 24*a* rotates counterclockwise in FIG. 15, the driven member 64 is pressed down by the drive cam 24*a*. During this operation, since the driven member 64 is coupled to the pivot member 61 by the coupling pin 65, the pivot member 61 is pivoted around the control shaft 60 while causing the ring-shaped portion 61*a* to slide on the outer peripheral surface of the control shaft 60. Thereby, the pivot portion 61*b* of the pivot member 61 presses down the tappet 58, and the valve body 53 moves downward (lift), so that the intake port 20A is opened.

Figure 16:
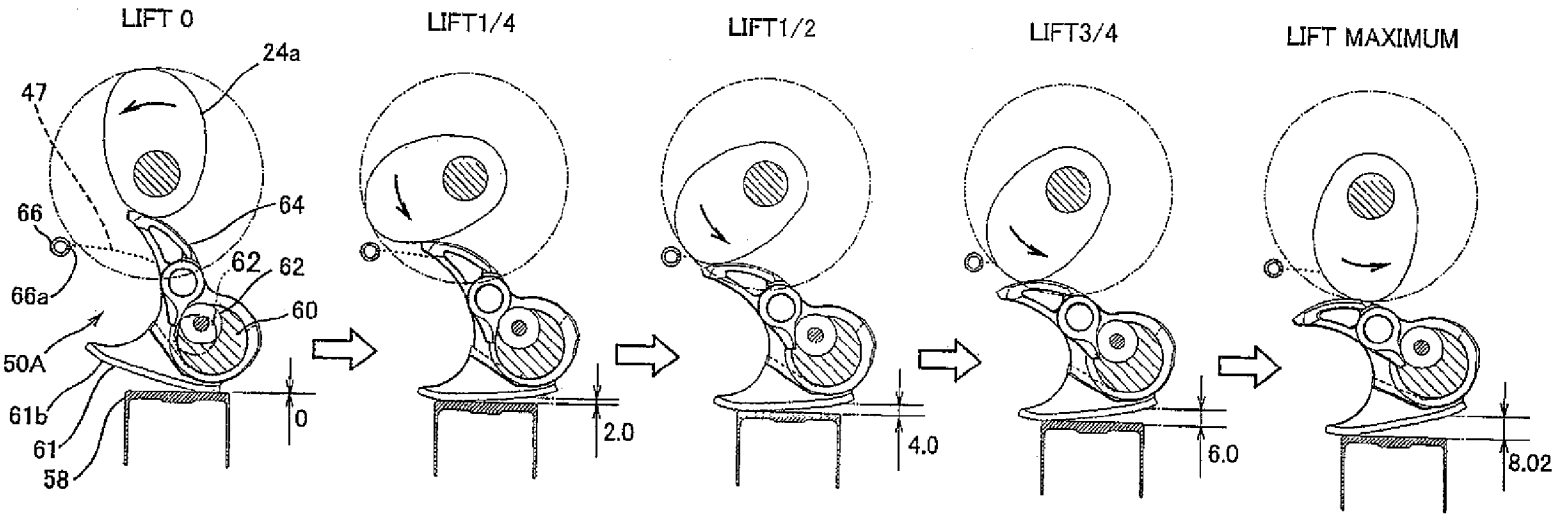
FIG. 16 is a view showing the operation for changing a phase of the valve operating system of FIG. 4.

FIG. 16 is a view showing the operation for changing the phase of the valve operating system 50A of FIG. 4. When the servo motor 73 receives a signal as an input from the controller 110 (see FIG. 10), it rotates the output shaft 73*a*, causing the control shaft 60 to rotate in association with the worm 84 and the worm wheel 83. At this time, the roller 62 moves around the axis of the control shaft 60 along with the control shaft 60 (In FIG. 16, the roller 62 moves from a position indicated by two-dotted line to a position indicated by an solid line). The rotational angle of the control shaft 60 at this time is detected by the angle sensor 92 and sent to the controller via the signal line 105. The controller determines whether or not the detected rotational angle coincides with a predetermined rotational angle (or input rotational angle). If it is determined that the detected rotational angle does not coincide with the predetermined rotational angle, the controller continues to drive the servo motor 73, whereas if it is determined that the detected rotational angle coincides with the predetermined rotational angle, the controller stops the servo motor 73. When the control shaft 60 is rotated in this way, the position of the lever portion 84*c* of the driven member 64 contacting the roller 62 changes, changing an angle (phase) formed between the driven member 64 and the pivot member 61. That is, the relative positions of the lever portion 64*c* and the roller 62 change.

When the relative positions of the lever portion 64*c* and the roller 62 change, the pivot state of the pivot cam 82 changes. To be specific, the pivot range of the pivot cam 82 changes, and the position of the pivot cam 82 contacting the tappet 58 and the position of the pivot cam 82 contacting the drive cams 24*a* and 25*a* change. As a result, the lift characteristics, to be precise, the open and close times, open and closing timings, and lift amount, of the valve body 53 which is pressed down by the pivot member 62 via the tappet 58, are changed. In detail, when the angle formed between the driven portion 64*b* and the pivot portion 61*b* is reduced, the open time of the valve body 53 becomes short, the lift amount of the valve body 53 becomes small, and the operation timing of the valve body 53 becomes late. To the contrary, when the angle formed between the driven portion 64*b* and the pivot portion 61*b* is increased, the open time of the valve body 53 becomes long, the lift amount of the valve body 53 becomes large, and the operation timing of the valve body 53 becomes earlier.

In accordance with the above described configuration, since the servo motor 73 is positioned at the left end portion of the pivot cam mechanism 48 such that the servo motor 73 is distant from the driving power transmission mechanism 28, the servo motor 73 does not affect the shapes and arrangement of the driving power transmission mechanism 28 and the pivot cam mechanism 48 in design, and therefore there is less restriction in design of these components. That is, flexibility of the design of the engine is improved.

Since the driving power transmission mechanism 28 is provided at the right end side of the control shaft 60 and is positioned at the right end portion of the casing 100, the driving power transmission mechanism 28 and the servo motor 73 will not affect the structures in an intermediate potion of the pivot cam mechanism 48, for example, the shape and arrangement of the pivot cams 82 in design. Therefore there is less restriction in design of these structures. That is, flexibility of the design of the engine is improved.

Since the servo motor 73 is mounted to the outer peripheral portion of the cylinder head 20, the valve operating system space 111 is increased, and thus flexibility of the design of the engine is improved. In addition, the mounting operation and maintenance for the servo motor 73 from outside the casing 100 is facilitated. Furthermore, the casing 100 is configured compactly and cooling efficiency of the servo motor 73 is improved.

The stopper 90 serves to inhibit the rotation of the control shaft 60 the predetermined angle θ or larger so that the control shaft 60 is controlled in a range in which the lift characteristics of the intake valve mechanism 51A and the exhaust valve mechanism 51 are favorable. Since the servo motors 73 are positioned at the left end portion of the casing 100 which is elongated in the rightward and leftward direction, they can be made distant from the combustion chambers 52. This can lessen the heat which is to be transmitted to the servo motors 73 in contrast to the configuration in which the servo motors 73 are positioned in close proximity to the combustion chambers. As a result, the life of the servo motors 73 is increased.

The servo motors 73 enable the control shaft 60 for air-intake and the control shaft 60 for air-exhaust to be independently angularly displaced so that the pivot state of the pivot cam 82 for air-intake and the pivot state of the pivot cam 82 for air-exhaust are changed independently. This makes it possible to independently change the lift characteristics of the valve bodies 53 for air-intake and the lift characteristics of the valve bodies 53 for air-exhaust. By selecting the lift characteristics of the valve body 53 for air-intake and the lift characteristics of the valve body 53 for air-exhaust from among various lift characteristics and moving the valve bodies 53 according to the selected lift characteristics, various engine properties are attainable.

Since the servo motors 73 are positioned under the gear chamber 71, the casing 100 and the servo motors 73 overlap in a plan view. This reduces the size of the engine E.

Whereas the servo motors 73 are provided to respectively correspond to the pivot cam mechanisms 48, one servo motor 73 may be provided. In this case, the output shaft 73*a* of the servo motor 73 and the control shafts 60 may be caused to operate in association with each other by a switch device such as a clutch device. The switch device is configured to switch to transmit the rotation of the output shaft 73 to either one of the control shafts 60. Thereby, the number of components can be reduced, and the engine can be configured compactly.

Whereas in this embodiment, the washer 85 is configured to contact the casing 73*b* to reduce the load applied to the output shaft 73*a*, a support member supporting the worm 83 may be configured to receive the load, instead of the washer 85.

Whereas in this embodiment, the servo motors 73 are positioned at the left side and the driving power transmission mechanism 28 is positioned at the right side, they may be positioned in a reverse manner or otherwise in front and in rear, respectively. Instead of the servo motors 73 as the driving source, other driving sources, for example, rotation driving sources such as a stepping motor, a hydraulic pump and a hydraulic motor, or a direct-acting driving source such as an electromagnetic solenoid, a hydraulic piston or a linear motor may be used. Instead of the driving power transmission mechanism including the chain and the sprockets, a driving power transmission mechanism having an endless band other than the chain, gear trains, a shaft drive mechanism, etc may be used, as the driving power transmission mechanism.

Whereas the angle sensor 92 is communicatively coupled to the controller 110 via the signal line, it may be communicatively coupled to the controller 110 wirelessly. In this case, a favorable communication state is obtained because the cylinder head and the cylinder head cover do not cover these components.

Whereas in this embodiment, the stopper 90 includes the cylindrical shaft member 90*a*, the cylindrical elastic member 90*b*, and the cylindrical contact member 90*c*, the stopper 90 may omit the contact member 90*c*, and the worm wheel 83 may be configured to directly contact the elastic member 90*b*.

The configuration of the pivot cam mechanism 48 is not limited to the above embodiment. For example, the pivot center of the pivot member 61, the support center of the driven member 64 and the support center of the pivot member 61 may be located on the same position, instead of the different positions as described in this embodiment.

In this embodiment, the position changing mechanism 80A is provided for each of the intake-side valve operating system 50A and the exhaust-side valve operating system 50B. Nonetheless, the same advantages are achieved by using the configuration in which the position changing mechanism 80A is provided for either one of the valve operating systems 50A and 50B.

Figure 17:
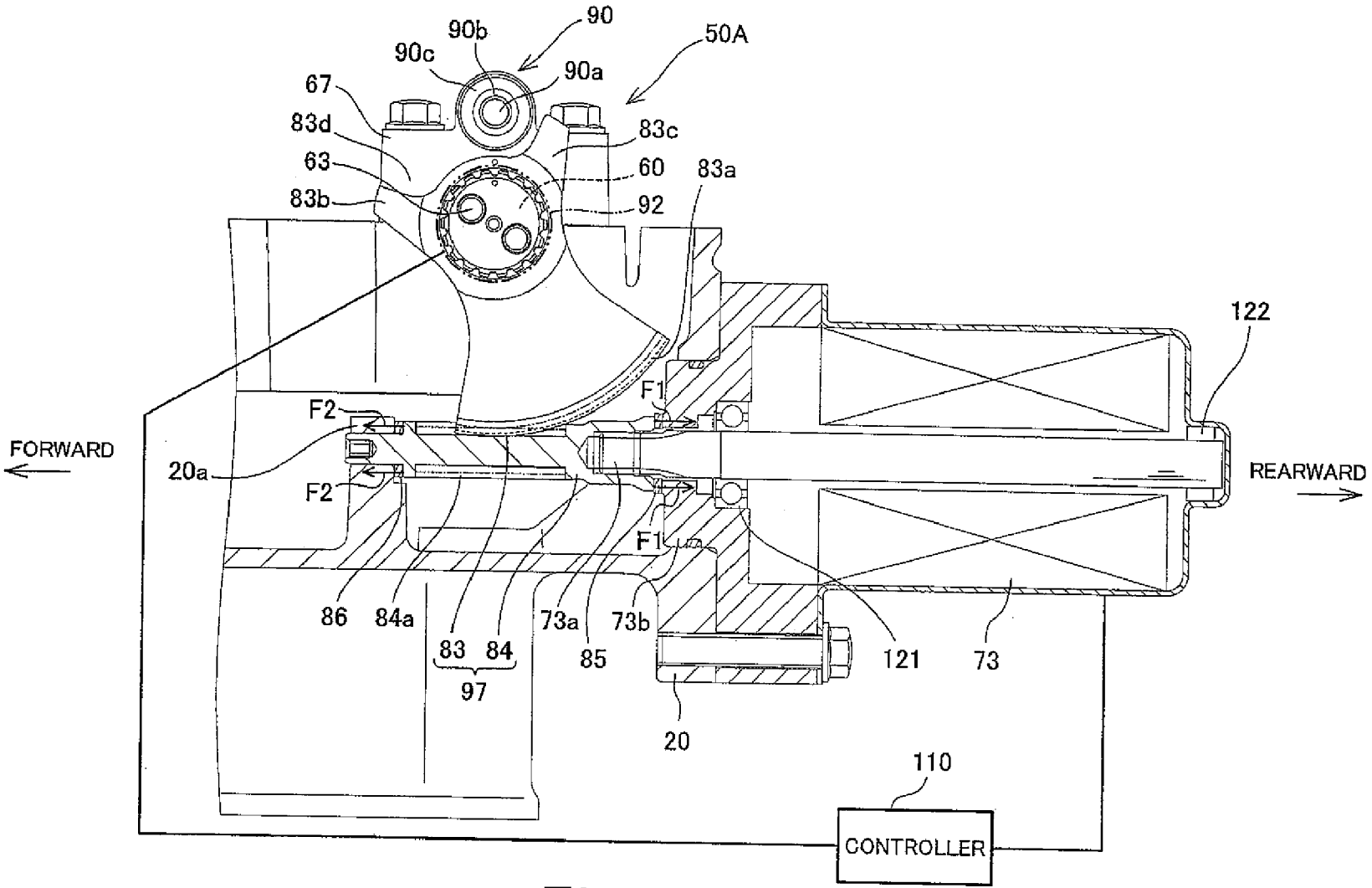
FIG. 17 is a left side view of an engine E1 according to Embodiment 2, in which a part of air-intake components is enlarged.

FIG. 17 is a left side view of an engine E1 according to Embodiment 2, a part of the intake-side components of the engine E1 being enlarged. The engine E1 of Embodiment 2 is similar in configuration to the engine E of Embodiment 1. The components and members of the engine E1 of Embodiment 2 which is different from that of Embodiment 1 will be described. The same components and members as those of the engine E of Embodiment 1 are identified by the same reference numbers, and will not be further described.

In the engine E1, the relative position changing mechanism 80A for changing the phase between the driven member 64 and the pivot member 61 is provided for the intake-side valve operating system 50A, but is not provided for the exhaust-side valve operating system 50B. The servo motor 73 for driving the relative position changing mechanism 80A is mounted to a rear side of the outer peripheral portion of the cylinder head 20 and a part of it protrudes rearward from the cylinder head 20. In a region behind the cylinder head 20 (region between the cylinder head 20 and the tank 12), there is an extra space in which the servo motor 73 is installed, and therefore the servo motor 73 can be installed there.

The output shaft 73*a* of the servo motor 73 is oriented to extend substantially horizontally. Accordingly, the worm 84 is oriented to extend substantially horizontally. The worm wheel 83 is positioned such that the gear portion 83*a* is directed downward to be engageable with the worm 84. By mounting the servo motor 73 such that the output shaft 73*a* extends substantially horizontally, a case opening of the servo motor 73 from which the output shaft 73*a* protrudes to outside does not face upward. This makes it possible to prevent entry of dust into the inside of the servo motor 73 through the case opening.

The tip end portion and base end portion of the output shaft 73*a* are supported by bearings 121 and 122 of the servo motor 73, respectively. Since the output shaft 73*a* of the servo motor 73 extends substantially horizontally, it is possible to reduce the influence of the weights of the output shaft 73*a* and members which are movable together with the output shaft 73*a* (e.g., movable iron core or magnet portion) with respect to the thrust load applied to the bearings 121 and 122 at the tip end side and the base end side, respectively, as compared to the configuration in which the output shaft 73*a* is oriented to extend vertically. Especially, since the influence of the thrust load applied to the bearing 122 at the base end side can be reduced, durability in the thrust direction of the bearing 122 at the base end side is improved.

One end of the axial portion of the worm 84 is in contact with and supported by a casing 73*b* of the servo motor 73 via the washer 85. Therefore, the casing 73*b* can receive a thrust load F1 toward the servo motor 73 which is applied from the worm wheel 85 to the worm 84, i.e., the thrust load F1 in one axial direction. The opposite end of the axial portion of the worm 84 is rotatably supported by the vertically extending support portion 20*a*. The vertically extending support portion 20*a* can receive a thrust load F2 which is applied in an opposite axial direction from the worm wheel 85 to the worm 84. In this way, the components other than the output shaft 73*a* can receive the thrust loads F1 and F2 in the one axial direction and in the opposite axial direction. As a result, it is possible to prevent transmission of the thrust load to the output shaft support members of the servo motor 7, such as the bearings 121 and 122, and thus the output shaft support member is protected.

Whereas in this embodiment, the servo motor 73 is disposed such that the output shaft 73*a* is oriented to extend substantially horizontally, the servo motor 73 may be disposed such that the output shaft 73*a* extends downward. Also, in this case, the case opening faces downward, and thus entry of dust into the inside of the servo motor 73 is prevented.

Having described the in-line four-cylinder DOHC engine E in Embodiment 1 and Embodiment 2, the engine may be V-type engine or a series engine. The engine may be configured to include a single cylinder, or multiple cylinders such as two cylinders, or six cylinders. The valve may be a single overhead cam (SHOC) valve, or an overhead valve (OHV). The configuration may be used so long as the cylinder head cover 21 is slidable relative to the cylinder head 20.

Having described the motorcycle in Embodiment 1 and Embodiment 2, the present invention may be applied to other vehicles. Moreover, the lubricating structure of the valve operating system of the present is not limited to the above described embodiments, but alternation, addition or deletion thereof can be made without departing from the scope of the present invention.

The invention claimed is:

1. An engine comprising:

a valve configured to open and close a port formed in a cylinder head covered with a cylinder head cover;

a drive cam mechanism operable in association with a crankshaft by a driving power transmission mechanism;

a pivot cam mechanism including a pivot cam which is configured to be pivoted according to movement of the drive cam mechanism to cause the valve to open and close and is configured to change a pivot state to change a lift characteristic of the valve and a control shaft configured to be angularly displaced to change the pivot state of the pivot cam; and a driving source positioned at one end portion of the pivot cam mechanism such that the driving source is distant from the driving power transmission mechanism, the driving source being configured to angularly displace the control shaft to change the pivot state of the pivot cam;

wherein the control shaft is positioned in an inner space defined by the cylinder head and the cylinder head cover;

wherein the driving source is a motor including an output shaft for angularly displacing the control shaft and a motor casing from which the output shaft rotatably protrudes;

wherein the output shaft is positioned in the inner space; and wherein the motor casing is positioned outside the inner space and mounted to an outer peripheral portion of the cylinder head.

2. The engine according to claim 1, wherein the drive cam mechanism includes a camshaft which is angularly displaceable and a drive cam provided at the camshaft; and wherein the control shaft is positioned substantially below the camshaft and the motor casing is positioned below the camshaft.

3. The engine according to claim 1, wherein the output shaft protrudes substantially upward from the motor casing.

4. The engine according to claim 1, wherein the output shaft is positioned substantially below a camshaft of the drive cam mechanism.

5. The engine according to claim 1, wherein the output shaft is oriented to extend substantially horizontally.

6. The engine according to claim 1, wherein the control shaft is attached with a displacement detecting means configured to detect a displacement amount of the control shaft, wherein the displacement detecting means is provided at one axial end portion of the control shaft and outside the inner space, and the displacement detecting means is mounted to the outer peripheral surface of the cylinder head with a seal member provided between the cylinder head and the cylinder head cover to seal the inner space.

7. The engine according to claim 1, wherein, the driving source is configured to angularly displace the control shaft in association with a worm gear mechanism including a worm mounted to the output shaft and a worm wheel mounted to one axial end side of the control shaft; and the worm is mounted to the output shaft such that the worm is slidable in an axial direction of the output shaft and one axial end portion of the worm is supported by a worm support member separate from an output shaft portion supporting the output shaft.

8. The engine according to claim 7, wherein the worm support member is a part of the motor casing and is configured to inhibit the worm from sliding in one direction of the axial direction thereof.

9. The engine according to claim 8, wherein the worm is provided with a support portion at an opposite axial end portion thereof to inhibit the worm from sliding in an opposite direction of the axial direction of the output shaft; and the support portion being provided in the cylinder head.

10. The engine according to claim 7, wherein the worm wheel has a sector form.

11. The engine according to claim 7, further comprising:

a stopper configured to inhibit the control shaft from being angularly displaced a predetermined displacement amount or larger;

wherein the stopper is configured to contact the worm wheel to inhibit displacement of the control shaft and is elastically deformable.

12. A vehicle including the engine as recited in claim 1.

* * * * *